US011952895B2

(12) United States Patent
Clausen et al.

(10) Patent No.: US 11,952,895 B2
(45) Date of Patent: Apr. 9, 2024

(54) WIRED DOWNHOLE ADJUSTABLE MUD MOTORS

(71) Applicant: National Oilwell Varco, L.P., Houston, TX (US)

(72) Inventors: Jeffery Ronald Clausen, Tulsa, OK (US); Nicholas Ryan Marchand, Edmonton (CA)

(73) Assignee: National Oilwell Varco, L.P., Houston, TX (US)

( * ) Notice: Subject to any disclaimer, the term of this patent is extended or adjusted under 35 U.S.C. 154(b) by 0 days.

(21) Appl. No.: 18/138,895

(22) Filed: Apr. 25, 2023

(65) Prior Publication Data

US 2023/0279728 A1 Sep. 7, 2023

Related U.S. Application Data

(63) Continuation of application No. 17/480,319, filed on Sep. 21, 2021, now Pat. No. 11,668,136, which is a (Continued)

(51) Int. Cl.
*E21B 7/06* (2006.01)
*E21B 4/02* (2006.01)

(Continued)

(52) U.S. Cl.
CPC ..... *E21B 7/068* (2013.01); *E21B 4/02* (2013.01); *E21B 7/067* (2013.01); *E21B 21/08* (2013.01);

(Continued)

(58) Field of Classification Search
CPC ..... E21B 7/068; E21B 7/067; E21B 4/02
See application file for complete search history.

(56) References Cited

U.S. PATENT DOCUMENTS 5,117,927 A * 6/1992 Askew ..... E21B 7/067 175/325.2
5,311,953 A * 5/1994 Walker ..... E21B 17/1014 175/325.1

(Continued)

OTHER PUBLICATIONS

Extended European Search Report dated Jan. 17, 2024, for Application No. EP 23211622.8.

(Continued)

*Primary Examiner* — Shane Bomar
(74) *Attorney, Agent, or Firm* — Conley Rose, P.C.

(57) ABSTRACT

A downhole motor for directional drilling includes a driveshaft assembly including a driveshaft housing and a driveshaft rotatably disposed within the driveshaft housing, a bearing assembly including a bearing housing and a bearing mandrel rotatably disposed within the bearing housing, wherein the bearing mandrel is configured to couple with a drill bit, a bend adjustment assembly configured to adjust a bend setting of the downhole motor, a lock piston including an unlocked position, and a locked position configured to lock the bend setting of the bend adjustment assembly, one or more hydraulic pumps configured to actuate the lock piston into the unlocked position to unlock the bend adjustment assembly, and an electronics package configured to indicate the bend setting of the bend adjustment assembly.

16 Claims, 23 Drawing Sheets

Related U.S. Application Data continuation of application No. 16/398,177, filed on Apr. 29, 2019, now Pat. No. 11,149,498.

(60) Provisional application No. 62/663,669, filed on Apr. 27, 2018.

(51) Int. Cl.

| | |
|---|---|
| ***E21B 21/08*** | (2006.01) |
| *E21B 47/024* | (2006.01) |
| *E21B 47/06* | (2012.01) |
| *E21B 47/07* | (2012.01) |
| *E21B 47/09* | (2012.01) |
| *E21B 47/13* | (2012.01) |

(52) U.S. Cl.

CPC ..... *E21B 47/024* (2013.01); *E21B 47/06* (2013.01); *E21B 47/07* (2020.05); *E21B 47/09* (2013.01); *E21B 47/13* (2020.05)

(56) References Cited

U.S. PATENT DOCUMENTS 5,448,227 A * 9/1995 Orban ..... E21B 47/022 340/855.8
5,924,499 A 7/1999 Birchak et al.
9,932,821 B2 * 4/2018 Lange ..... E21B 47/024
2013/0051716 A1 2/2013 Cioceanu
2014/0262530 A1 * 9/2014 Petrovic ..... E21B 7/067 175/107
2015/0053485 A1 * 2/2015 Altimas ..... E21B 47/13 175/107
2015/0240580 A1 * 8/2015 Prill ..... E21B 7/068 175/317
2016/0215610 A1 * 7/2016 Lange ..... E21B 17/20
2017/0074042 A1 * 3/2017 Peters ..... E21B 47/00
2017/0234071 A1 * 8/2017 Spatz ..... E21B 10/26 175/61
2018/0023347 A1 * 1/2018 Bleeker ..... E21B 7/062 175/57
2018/0066513 A1 3/2018 Sugiura et al.
2022/0010625 A1 * 1/2022 Williams ..... E21B 4/02
2022/0186567 A1 * 6/2022 Fox ..... E21B 7/067
2023/0349283 A1 * 11/2023 Clausen ..... E21B 44/06

OTHER PUBLICATIONS

U.A.E. Search Report and Office Action dated Dec. 26, 2023, for Application No. P6001500/20.

* cited by examiner

WIRED DOWNHOLE ADJUSTABLE MUD MOTORS

CROSS-REFERENCE TO RELATED APPLICATIONS

This application is a continuation of U.S. nonprovisional patent application Ser. No. 17/480,319 filed Sep. 21, 2021, entitled "Wired Downhole Adjustable Mud Motors", which is a continuation of U.S. nonprovisional patent application No. 16,398,177 filed Apr. 29, 2019, now U.S. Pat. No. 11,149,498 issued Oct. 19, 2021, entitled "Wired Downhole Adjustable Mud Motors," which claims benefit of U.S. provisional patent application Ser. No. 62/663,669 filed Apr. 27, 2018, entitled "Wired Downhole Adjustable Mud Motors," all of which are hereby incorporated herein by reference in their entirety.

STATEMENT REGARDING FEDERALLY SPONSORED RESEARCH OR DEVELOPMENT

Not applicable.

BACKGROUND

It has become increasingly common in the oil and gas industry to use "directional drilling" techniques to drill horizontal and other non-vertical wellbores, to facilitate more efficient access to and production from larger regions of subsurface hydrocarbon-bearing formations than would be possible using only vertical wellbores. In directional drilling, specialized drill string components and "bottom-hole assemblies" (BHAs) are used to induce, monitor, and control deviations in the path of the drill bit, so as to produce a wellbore of desired non-vertical configuration.

Directional drilling is typically carried out using a "down-hole motor" (alternatively referred to as a "mud motor") incorporated into the drill string immediately above the drill bit. A typical mud motor generally includes a top sub adapted to facilitate connection to the lower end of a drill string, a power section comprising a positive displacement motor of well-known type with a helically-vaned rotor eccentrically rotatable within a stator section, a drive shaft enclosed within a drive shaft housing, with the upper end of the drive shaft being operably connected to the rotor of the power section, and a bearing section comprising a cylindrical mandrel coaxially and rotatably disposed within a cylindrical housing, with an upper end coupled to the lower end of the drive shaft, and a lower end adapted for connection to a drill bit. The mandrel is rotated by the drive shaft, which rotates in response to the flow of drilling fluid under pressure through the power section, while the mandrel rotates relative to the cylindrical housing, which is connected to the drill string. Directional drilling allows the well to be drilled out at an angle. A bent housing motor is used to form a curved well path. The bent housing is often located above the bearing section and below the power section.

The wellbore of at least some drilling systems includes a vertical section extending from the surface, a curved section extending from a lower end of the vertical section, and a lateral section extending from the curved section. A trip to the surface of the wellbore for the downhole motor may be required to change a bend setting on the downhole motor as the drill bit and downhole motor of the drilling system enters a new section of the wellbore. For instance, in at least some applications the vertical section of the wellbore may be drilled with the downhole motor disposed at approximately a 0.5-1 degree bend to allow small corrections when needed to maintain verticality (e.g., inclination below 5 degrees), but still give an operator of the drilling system the ability to rotary drill spinning the downhole motor at relatively higher rotational speeds (e.g., 30-100 revolutions per minute (RPM)) to allow faster rates of penetration (ROPs) without damaging the downhole motor. Bend settings of the down-hole motor greater than 1 degree and rotary RPM over 50 RPM may lead to premature failure of a bearing assembly and/or a bend housing of the downhole motor or motor adjustable housing in at least some applications.

In some applications, the curved section of the wellbore may demand a bend setting of the downhole motor of approximately 1-3 degrees or greater to achieve an inclination or curve of approximately 3-16 degrees/100 feet. Bend settings of the downhole motor 1-3 degrees or greater generally do not allow for the rotational speeds above approximately 50 RPM. Because of this limitation another trip to the surface of the wellbore may be required to reduce the bend setting of the downhole motor once the operator reaches the lateral section of the wellbore. The high bend setting required by the curved section is typically not needed in the lateral section of the wellbore, and thus, a downhole motor having a bend setting of approximately 0.5-1.5 degrees may be utilized to drill the lateral section of the wellbore and thereby maintain the desired inclination while drilling at high ROPs.

During a directional drilling operation, sensors associated with the downhole motor (measurement while drilling (MWD) sensors, etc.) can fail, and/or the wellbore can have severe stick slip causing tool damage and eventual failure. Typically, when the drilling system does not include a rotary steerable system (RSS) positioned below the downhole motor the total RPM of the drill bit and other critical data cannot be collected. Generally, conventional downhole motor technology utilizes fixed bent housings or externally adjustable housings that allow a range of bend settings of the downhole motor to be chosen and locked in place at the surface of the wellbore, not allowing the operator of the drilling system to change the bend setting of the mud motor downhole. RSS tools generally allow the operator to effectively change the amount of steering the RSS tool offers via downlinks or some sort of communication from the surface of the wellbore, but RSS tools may be relatively expensive and complex to operate compared to conventional downhole motors. RSS tools also do not generally have the reliability of a downhole motor and typically have a Lost in Hole (LIH) cost approximately 3-10 times that of a conventional bent motor.

RSS tools also allow the use of electronics to collect data on inclination, vibration, and stick slip during downhole operation. This data may be valuable to operators when tuning parameters to extend drilling intervals downhole and limit damage to tools. Conventional downhole motors typically do not collect data on total bit RPM, torque, stick slip, vibration, and inclination. Further, logging tools are typically not short enough to be housed below the downhole motor without being a detriment to the downhole motor's build rate. Conventional commercial logging tools may be either collar based and run above the downhole motor or collar based and run in a short sub below the downhole motor near the drill bit. Generally, running tools positioned below the downhole motor may increase the bit to bend distance of the downhole motor and thus decrease the build rate of the downhole motor.

BRIEF SUMMARY OF THE DISCLOSURE

An embodiment of a downhole motor for directional drilling comprises a driveshaft assembly including a driveshaft housing and a driveshaft rotatably disposed within the driveshaft housing, a bearing assembly including a bearing housing and a bearing mandrel rotatably disposed within the bearing housing, wherein the bearing mandrel is configured to couple with a drill bit, a bend adjustment assembly configured to adjust a bend setting of the downhole motor, a lock piston comprising an unlocked position, and a locked position configured to lock the bend setting of the bend adjustment assembly, one or more hydraulic pumps configured to actuate the lock piston into the unlocked position to unlock the bend adjustment assembly, and an electronics package configured to indicate the bend setting of the bend adjustment assembly. In some embodiments, the electronics package is configured to indicate whether lock piston is in the locked position or the unlocked position. In some embodiments, the downhole motor comprises a solenoid valve configured to lock the lock piston into at least one of the locked and unlocked positions in response to receiving a locking signal. In certain embodiments, the bend adjustment assembly comprises an actuator piston configured to, in response to actuating the actuator piston from a deactivated position to an activated position, actuate the bend adjustment assembly between a first position that provides a first deflection angle between a longitudinal axis of the driveshaft housing and a longitudinal axis of the bearing mandrel, and a second position that provides a second deflection angle between the longitudinal axis of the driveshaft housing and the longitudinal axis of the bearing mandrel that is different from the first deflection angle. In certain embodiments, the electronics package is configured to indicate whether the actuator piston is in the deactivated position or the activated position. In some embodiments, the electronics package comprises an electromagnetic short hop transmitter configured to communicate with an electromagnetic short hop receiver disposed in a measurement-while-drilling (MWD) tool coupled to the downhole motor. In some embodiments, the electronics package comprises an electromagnetic communication link. In certain embodiments, the one or more hydraulic pumps are configured to actuate the bend adjustment assembly includes a first position that provides a first deflection angle between a longitudinal axis of the driveshaft housing and a longitudinal axis of the bearing mandrel, and a second position that provides a second deflection angle between the longitudinal axis of the driveshaft housing and the longitudinal axis of the bearing mandrel that is different from the first deflection angle.

An embodiment of a downhole motor for directional drilling comprises a driveshaft assembly including a driveshaft housing and a driveshaft rotatably disposed within the driveshaft housing, a bearing assembly including a bearing housing and a bearing mandrel rotatably disposed within the bearing housing, wherein the bearing mandrel is configured to couple with a drill bit, a bend adjustment assembly configured to adjust a bend setting of the downhole motor, a lock piston comprising an unlocked position, and a locked position configured to lock the bend setting of the bend adjustment assembly, a solenoid valve configured to lock the lock piston into at least one of the locked and unlocked positions in response to receiving a locking signal, and an electronics package configured to indicate the bend setting of the bend adjustment assembly. In certain embodiments, the electronics package is configured to indicate whether lock piston is in the locked position or the unlocked position. In some embodiments, the downhole motor comprises a hydraulic pump configured to actuate the lock piston into the unlocked position to unlock the bend adjustment assembly. In some embodiments, the bend adjustment assembly comprises an actuator piston configured to, in response to actuating the actuator piston from a deactivated position to an activated position, actuate the bend adjustment assembly between a first position that provides a first deflection angle between a longitudinal axis of the driveshaft housing and a longitudinal axis of the bearing mandrel, and a second position that provides a second deflection angle between the longitudinal axis of the driveshaft housing and the longitudinal axis of the bearing mandrel that is different from the first deflection angle. In certain embodiments, the electronics package is configured to indicate whether the actuator piston is in the deactivated position or the activated position. In certain embodiments, the electronics package comprises an electromagnetic short hop transmitter configured to communicate with an electromagnetic short hop receiver disposed in a measurement-while-drilling (MWD) tool coupled to the downhole motor. In some embodiments, the electronics package comprises an electromagnetic communication link. In some embodiments, the downhole motor comprises one or more hydraulic pumps configured to actuate the bend adjustment assembly includes a first position that provides a first deflection angle between a longitudinal axis of the driveshaft housing and a longitudinal axis of the bearing mandrel, and a second position that provides a second deflection angle between the longitudinal axis of the driveshaft housing and the longitudinal axis of the bearing mandrel that is different from the first deflection angle.

BRIEF DESCRIPTION OF THE DRAWINGS

For a detailed description of exemplary embodiments of the disclosure, reference will now be made to the accompanying drawings in which.

DETAILED DESCRIPTION

Figure 1:
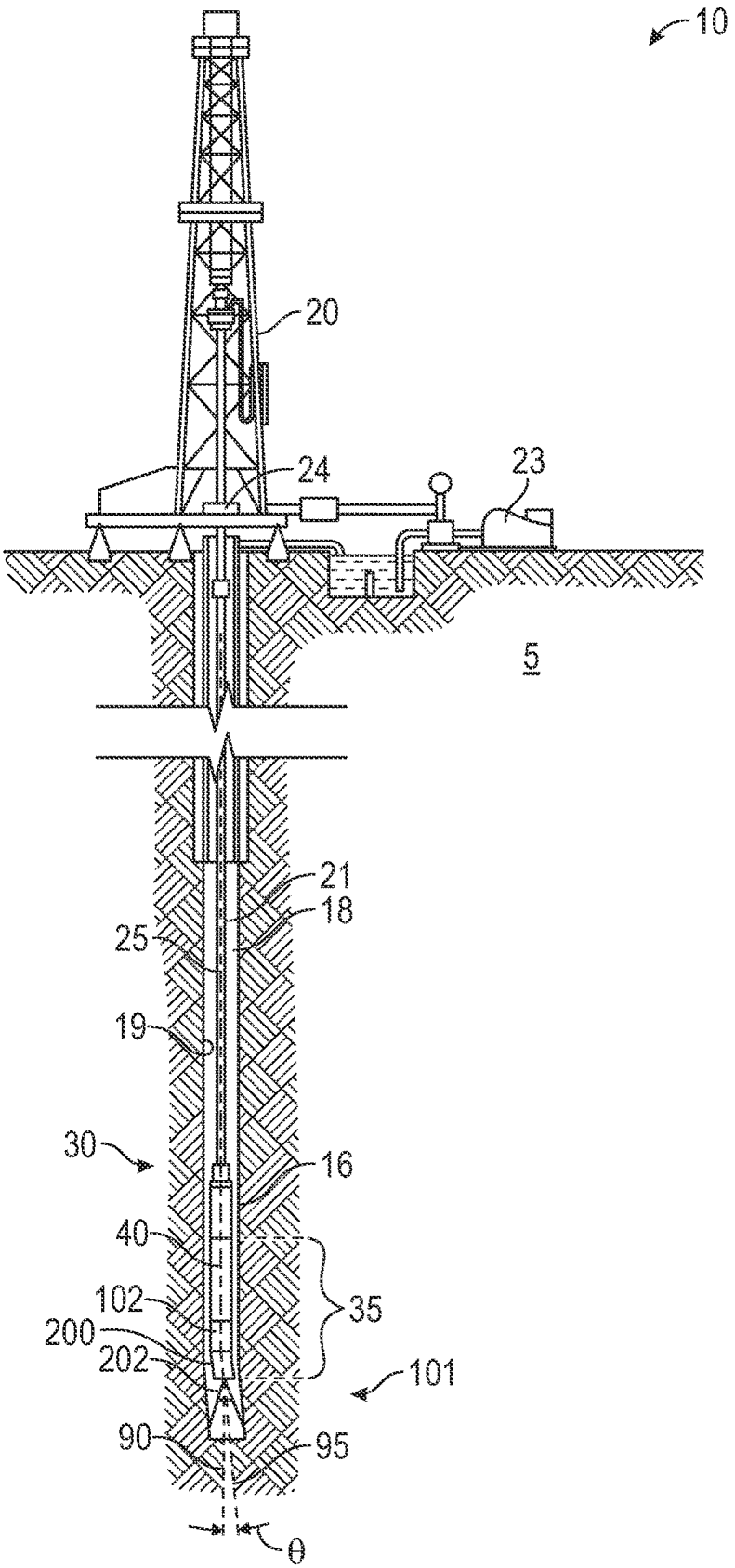
FIG. 1 is a schematic partial cross-sectional view of a drilling system including an embodiment of a downhole mud motor in accordance with principles disclosed herein.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment. Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation. Further, the term "fluid," as used herein, is intended to encompass both fluids and gasses.

Referring to FIG. 1, an embodiment of a well system 10 is shown. Well system 10 is generally configured for drilling a borehole 16 in an earthen formation 5. In the embodiment of FIG. 1, well system 10 includes a drilling rig 20 disposed at the surface, a drillstring 21 extending downhole from rig 20, a bottomhole assembly (BHA) 30 coupled to the lower end of drillstring 21, and a drill bit 90 attached to the lower end of BHA 30. A surface or mud pump 23 is positioned at the surface and pumps drilling fluid or mud through drillstring 21. Additionally, rig 20 includes a rotary system 24 for imparting torque to an upper end of drillstring 21 to thereby rotate drillstring 21 in borehole 16. In this embodiment, rotary system 24 comprises a rotary table located at a rig floor of rig 20; however, in other embodiments, rotary system 24 may comprise other systems for imparting rotary motion to drillstring 21, such as a top drive. A downhole mud motor 35 is provided in BHA 30 for facilitating the drilling of deviated portions of borehole 16. Moving downward along BHA 30, motor 35 includes a hydraulic drive or power section 40, a driveshaft assembly 102, and a bearing assembly 200. In some embodiments, the portion of BHA 30 disposed between drillstring 21 and motor 35 can include other components, such as drill collars, measurement-while-drilling (MWD) tools, reamers, stabilizers and the like.

Power section 40 of BHA 30 converts the fluid pressure of the drilling fluid pumped downward through drillstring 21 into rotational torque for driving the rotation of drill bit 90. Driveshaft assembly 102 and bearing assembly 200 of mud motor 35 transfer the torque generated in power section 40 to bit 90. With force or weight applied to the drill bit 90, also referred to as weight-on-bit ("WOB"), the rotating drill bit 90 engages the earthen formation and proceeds to form borehole 16 along a predetermined path toward a target zone. The drilling fluid or mud pumped down the drillstring 21 and through BHA 30 passes out of the face of drill bit 90 and back up the annulus 18 formed between drillstring 21 and the sidewall 19 of borehole 16. The drilling fluid cools the bit 90, and flushes the cuttings away from the face of bit 90 and carries the cuttings to the surface.

Figure 2:
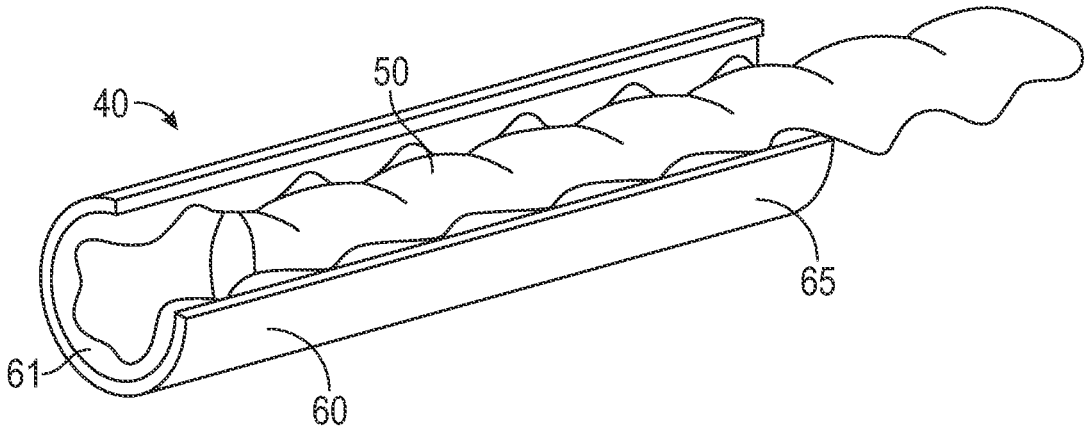
FIG. 2 is a perspective, partial cut-away view of the power section of FIG. 1.
Figure 3:
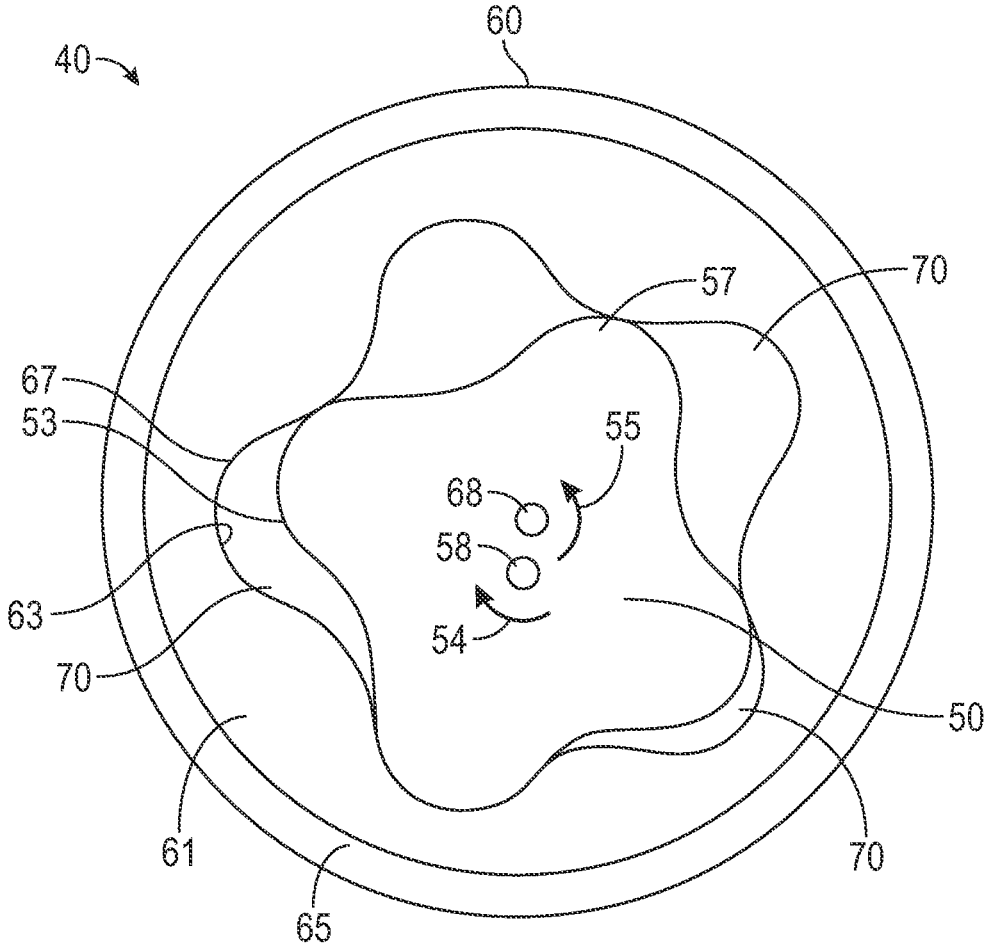
FIG. 3 is a cross-sectional end view of the power section of FIG. 1.

Referring to FIGS. 1-3, an embodiment of the power section 40 of BHA 30 is shown schematically in FIGS. 2 and 3. In the embodiment of FIGS. 2 and 3, power section 40 comprises a helical-shaped rotor 50 disposed within a stator 60 comprising a cylindrical stator housing 65 lined with a helical-shaped elastomeric insert 61. Helical-shaped rotor 50 defines a set of rotor lobes 57 that intermesh with a set of stator lobes 67 defined by the helical-shaped insert 61. As best shown in FIG. 3, the rotor 50 has one fewer lobe 57 than the stator 60. When the rotor 50 and the stator 60 are assembled, a series of cavities 70 are formed between the outer surface 53 of the rotor 50 and the inner surface 63 of the stator 60. Each cavity 70 is sealed from adjacent cavities 70 by seals formed along the contact lines between the rotor 50 and the stator 60. The central axis 58 of the rotor 50 is radially offset from the central axis 68 of the stator 60 by a fixed value known as the "eccentricity" of the rotor-stator assembly. Consequently, rotor 50 may be described as rotating eccentrically within stator 60.

During operation of the hydraulic drive section 40, fluid is pumped under pressure into one end of the hydraulic drive section 40 where it fills a first set of open cavities 70. A pressure differential across the adjacent cavities 70 forces the rotor 50 to rotate relative to the stator 60. As the rotor 50 rotates inside the stator 60, adjacent cavities 70 are opened and filled with fluid. As this rotation and filling process repeats in a continuous manner, the fluid flows progressively down the length of hydraulic drive section 40 and continues to drive the rotation of the rotor 50. Driveshaft assembly 102 shown in FIG. 1 includes a driveshaft discussed in more detail below that has an upper end coupled to the lower end of rotor 50. In this arrangement, the rotational motion and torque of rotor 50 is transferred to drill bit 90 via driveshaft assembly 102 and bearing assembly 200.

In the embodiment of FIGS. 1-3, mud motor 35 of BHA 30 is configured to provide a bend 101 along mud motor 35. Due to bend 101, a deflection or bend angle θ is formed between a central or longitudinal axis 95 of drill bit 90 and the longitudinal axis 25 of drillstring 21. To drill a straight section of borehole 16, drillstring 21 is rotated from rig 20 with a rotary table or top drive to rotate BHA 30 and drill bit 90 coupled thereto. Drillstring 21 and BHA 30 rotate about the longitudinal axis of drillstring 21, and thus, drill bit 90 is also forced to rotate about the longitudinal axis of drillstring 21. With bit 90 disposed at bend angle θ, the lower end of drill bit 90 distal BHA 30 seeks to move in an arc about longitudinal axis 25 of drillstring 21 as it rotates, but is restricted by the sidewall 19 of borehole 16, thereby imposing bending moments and associated stress on BHA 30 and mud motor 35.

In general, driveshaft assembly 102 functions to transfer torque from the eccentrically-rotating rotor 50 of power section 40 to a concentrically-rotating bearing mandrel 202 of bearing assembly 200 and drill bit 90. In this embodiment, bearing mandrel 202 includes a central bore or passage 203 that receives a flow of drilling fluid supplied to mud motor 35. Additionally, bearing assembly 200 includes a bearing housing 210 in which bearing mandrel 202 is rotatably disposed, and a sealed oil chamber 213 positioned radially between bearing housing 210 and bearing mandrel 202 and is sealed from central passage 203 of bearing mandrel 202. Additionally, bearing assembly 200 includes a rotary bearing (e.g., a thrust bearing, etc.) positioned in sealed oil chamber 213 for supporting relative rotation between bearing housing 210 and bearing mandrel 202.

As best shown in FIG. 3, rotor 50 rotates about rotor axis 58 in the direction of arrow 54, and rotor axis 58 rotates about stator axis 68 in the direction of arrow 55. However, drill bit 90 and bearing mandrel 202 are coaxially aligned and rotate about a common axis that is offset and/or oriented at an acute angle relative to rotor axis 58. Thus, driveshaft assembly 102 converts the eccentric rotation of rotor 50 to the concentric rotation of bearing mandrel 202 and drill bit 90, which are radially offset and/or angularly skewed relative to rotor axis 58.

Figure 4:
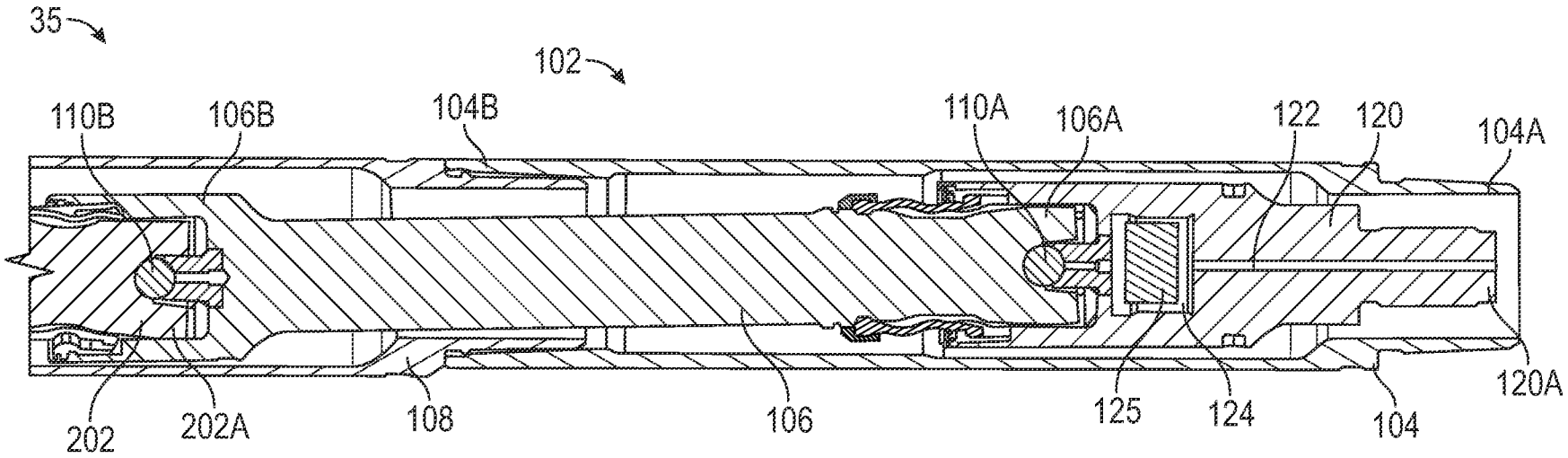
FIG. 4 is a side cross-sectional view of an embodiment of a downhole mud motor of the drilling system of FIG. 1 in accordance with principles disclosed herein.

Referring to FIGS. 1, 4, an embodiment of a downhole mud motor 35 of the BHA 30 of FIG. 1 is shown in FIG. 4. In the embodiment of FIGS. 1, 4, driveshaft assembly 102 of mud motor 35 includes an outer or driveshaft housing 104 and a one-piece (i.e., unitary) driveshaft 106 rotatably disposed within driveshaft housing 104. An externally threaded connector or pin end of driveshaft housing 104 located at a first or upper end 104A thereof threadably engages a mating internally threaded connector or box end disposed at the lower end of the stator housing 65 of stator 60 (not shown in FIG. 4), and an internally threaded connector or box end of driveshaft housing 104 located at a second or lower end 104B thereof threadably engages a mating externally threaded connector of a fixed bent housing 108 of mud motor 35. In this embodiment, bent housing 108 of mud motor 35 provides a fixed bend to mud motor 35. Thus, the fixed bend provided by fixed bend housing 108 provides or defines bend 101, with bend 101 comprising a fixed bend in this embodiment.

A first or upper end 106A of driveshaft 106 is pivotally coupled to the lower end of rotor 50 (not shown in FIG. 4) via a driveshaft adapter 120 and a first or upper universal joint 110A. Additionally, a second or lower end 106B of driveshaft 106 is pivotally coupled to a first or upper end 202A of the bearing mandrel 202 of the bearing assembly 200 via a second or lower universal joint 110B. Universal joints 110A, 110B may be similar in configuration to the universal joints shown and described in U.S. Pat. Nos. 9,347,269 and 9,404,527, each of which are incorporated herein by reference in their entirety. In this embodiment, a central passage or axial port 122 extends from a first or upper end 120A of driveshaft adapter 120, through driveshaft adapter 120, to a receptacle 124 formed within driveshaft adapter 120 which receives an electronics package 125 therein. In some embodiments, pressure sensors may be coupled to driveshaft adapter 120 and configured to detect fluid pressure axially above driveshaft adapter 120 (e.g., at the upper end of adapter 120) and axially below driveshaft adapter 120 (e.g., at a lower end of adapter 120). Although in this embodiment electronics package 125 is positioned in the receptacle 124 of driveshaft adapter 120, in other embodiments, electronics package 125 may be received in a receptacle formed in driveshaft 106 located proximal the lower universal joint 110B. Electronics package 125, which includes a sensor package in some embodiments, allows for measurements to be taken near drill bit 90 below power section 40 of mud motor 35.

Figure 5:
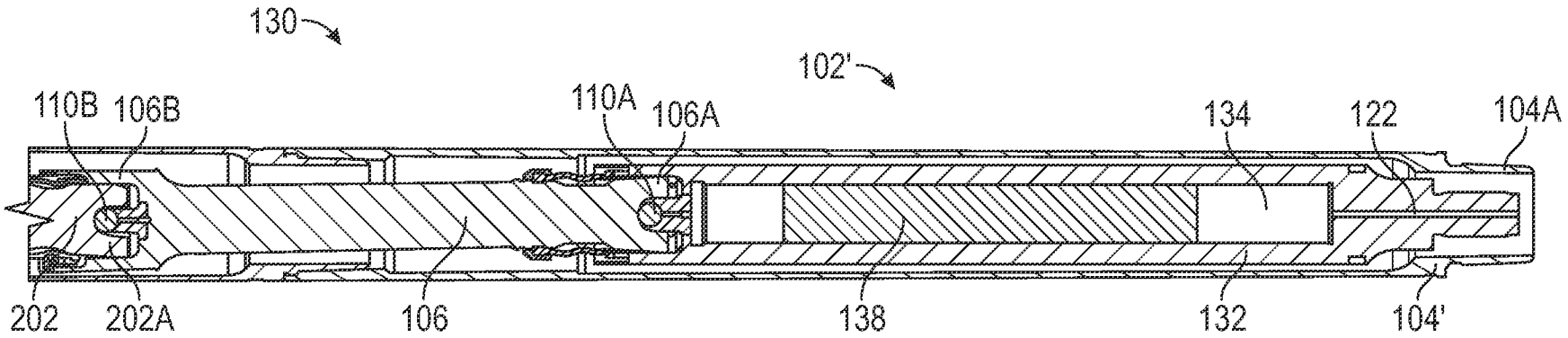
FIG. 5 is a side cross-sectional view of another embodiment of a downhole mud motor of the drilling system of FIG. 1 in accordance with principles disclosed herein.

In some embodiments, the driveshaft adapter 120 of mud motor 35 may include other electronics and sensor packages. For instance, referring briefly to FIGS. 1, 5, an embodiment of a mud motor 130 is shown in FIG. 5 that includes a driveshaft assembly 102' and driveshaft housing 104' similar in configuration to the driveshaft assembly 102 and driveshaft housing 104 shown in FIG. 4, and a driveshaft adapter 132 including a receptacle 134 that receives an electronics package 138. In the embodiment of FIGS. 1, 5, electronics package 138 includes an electromagnetic short hop communications link for communicating information downhole. In some embodiments, electronics package 138 allows for the near-bit measurement of seal boot pressure, drilling differential pressure, torque output, total RPM of drill bit 90, vibration, stick slip, and near-bit inclination, each of which may be recorded to a memory of electronics package 138. In some embodiments, a battery may be housed in rotor 50 (not shown in FIG. 5) of mud motor 130 for powering components (e.g., a short hop transmitter, etc.) of electronics package 138. In some embodiments, electronics package 138 allows below rotor sensors to communicate uphole (e.g., to a MWD tool located above mud motor 130) via a short hop electromagnetic transmitter of electronics package 138.

In some embodiments, instead of including a short hop transmitter, electronics package 138 includes a data port positionable in the upper end of rotor 50 of mud motor 130 for field data downloads. In some embodiments, drillstring 21, from which mud motor 130 is suspended, comprises a plurality of wired drill pipe joints (WDP joints) where the short hop transmitter of electronics package 138 permits communication between electronics of mud motor 130 and electronics positioned downhole from mud motor 130 with a MWD tool disposed uphole from mud motor 130 that is connected with the WDP joints of drillstring 21.

Referring to FIGS. 1, 6-14, an embodiment of a downhole adjustable mud motor 250 for use in the BHA 30 of FIG. 1 is shown in FIGS. 6-14. Mud motor 250 comprises a downhole adjustable mud motor 250 having a bend setting or position that defines deflection angle θ shown in FIG. 1, where the deflection angle θ defined by mud motor 250 may be adjusted or altered while mud motor 250 is positioned in borehole 16. In the embodiment of FIGS. 1, 6-14, mud motor 250 generally includes a driveshaft assembly 102" including a driveshaft housing 104", similar in configuration to driveshaft assembly 102 and driveshaft housing 104 shown in FIG. 4, a bend adjustment assembly 300, and bearing assembly 200. In some embodiments, bend adjustment assembly 300 includes features in common with the bend adjustment assemblies (e.g., bend adjustment assemblies 300, 700, and/or 400) shown and described in U.S. patent application Ser. No. 16/007,545 (published as US 2018/0363380), which is incorporated herein by reference in their entirety.

As will be discussed further herein, bend adjustment assembly 300 of mud motor 250 is configured to actuate between a first or unbent position 303 (shown in FIGS. 6, 7) defining a first deflection angle (the first deflection angle being zero in this embodiment), and a second or bent position providing a second deflection angle (deflection angle θ in this embodiment) between the longitudinal axis 95 of drill bit 90 and the longitudinal axis 25 of drill string 21. In other embodiments, bend adjustment assembly 300 is configured to actuate between the unbent position 303, a first bent position providing a first non-zero deflection angle, and a second bent position providing a second non-zero deflection angle which is different from the first deflection angle.

Bend adjustment assembly 300 couples driveshaft housing 104" to bearing housing 210, and selectably introduces deflection angle θ (shown in FIG. 1) along BHA 30. Central axis 105 of driveshaft housing 104" is coaxially aligned with axis 25, and central axis 215 of bearing housing 210 is coaxially aligned with axis 95, thus, deflection angle θ also represents the angle between axes 105, 215 when mud motor 250 is in an undeflected state (e.g., outside borehole 16). When bend adjustment assembly 300 is in unbent position 303, central axis 105 of driveshaft housing 104" extends substantially parallel with the central axis 215 of bearing housing 210. Additionally, bend adjustment assembly 300 is configured to adjust the degree of bend provided by mud motor 250 without needing to pull drill string 21 from borehole 16 to adjust bend adjustment assembly 300 at the surface, thereby reducing the amount of time required to drill borehole 16.

In this embodiment, bend adjustment assembly 300 generally includes a first or upper housing 302, an upper housing extension 310 (shown in FIG. 7), a second or lower offset housing 320, a locker or actuator housing 340, a piston mandrel 350, a first or upper adjustment mandrel 360, a second or lower adjustment mandrel 370, and a locking piston 380. Additionally, in this embodiment, bend adjustment assembly 300 includes a locker or actuator assembly 400 housed in the actuator housing 340, where locker assembly 400 is generally configured to control the actuation of bend adjustment assembly between the unbent position 303 and the bent position with BHA 30 disposed in borehole 16.

Figure 7:
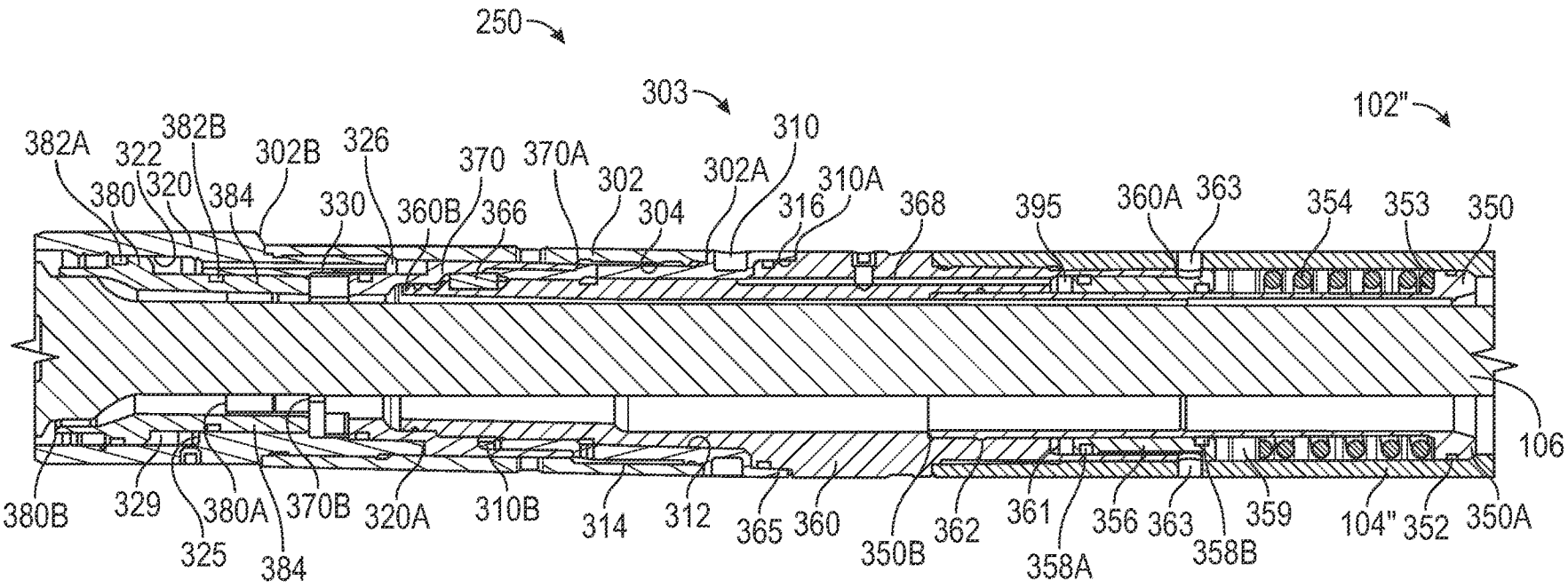
FIG. 7 is a side cross-sectional view of an embodiment of a bend adjustment assembly of the mud motor of FIG. 6 in accordance with principles disclosed herein.

As shown particularly in FIG. 7, upper housing 302 of bend adjustment assembly 300 is generally tubular and has a first or upper end 302A, a second or lower end 302B opposite upper end 302A, and a central bore or passage defined by a generally cylindrical inner surface 304 extending between a ends 302A, 302B. The inner surface 304 of upper housing 302 includes a first or upper threaded connector extending from upper end 302A, and a second or lower threaded connector extending from lower end 302B and coupled to lower offset housing 320. Upper housing extension 310 is generally tubular and has a first or upper end 310A, a second or lower end 310B, a central bore or passage defined by a generally cylindrical inner surface 312 extending between ends 310A and 310B, and a generally cylindrical outer surface 314 extending between ends 310A and 310B. In this embodiment, the inner surface 312 of upper housing extension 310 includes an engagement surface 316 extending from upper end 310A that matingly engages an offset engagement surface 365 of upper adjustment mandrel 360. Additionally, in this embodiment, the outer surface 314 of upper housing extension 310 includes a threaded connector coupled with the upper threaded connector of upper housing 302.

Figure 6:
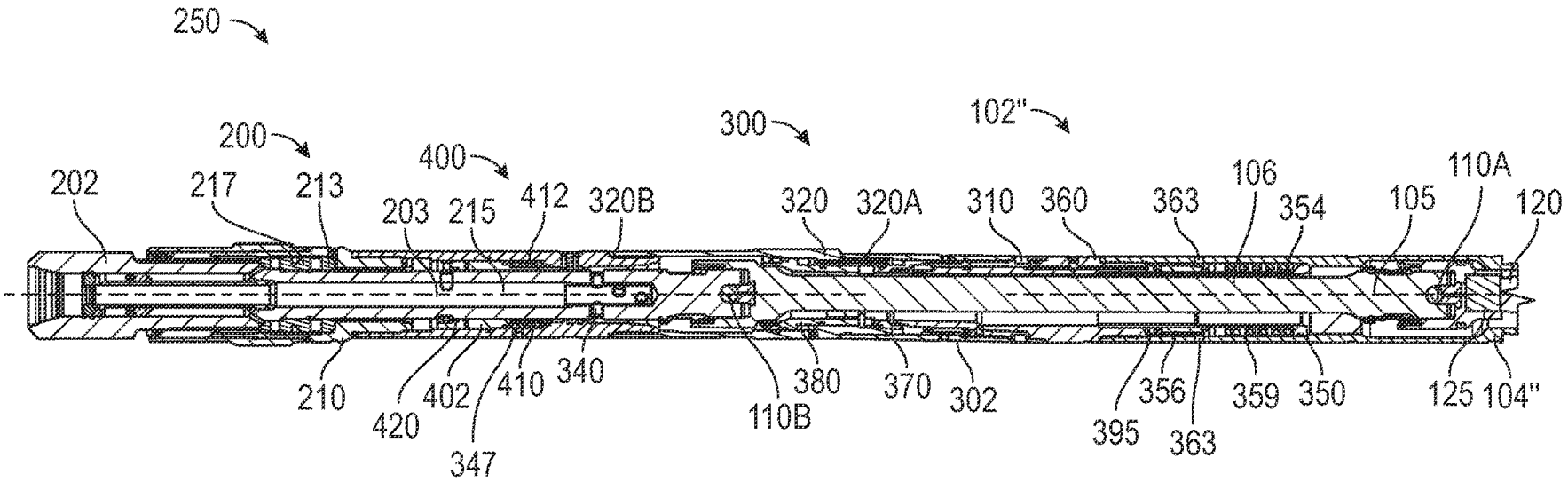
FIG. 6 is a side cross-sectional view of another embodiment of a downhole mud motor of the drilling system of FIG. 1 in accordance with principles disclosed herein.
Figure 9:
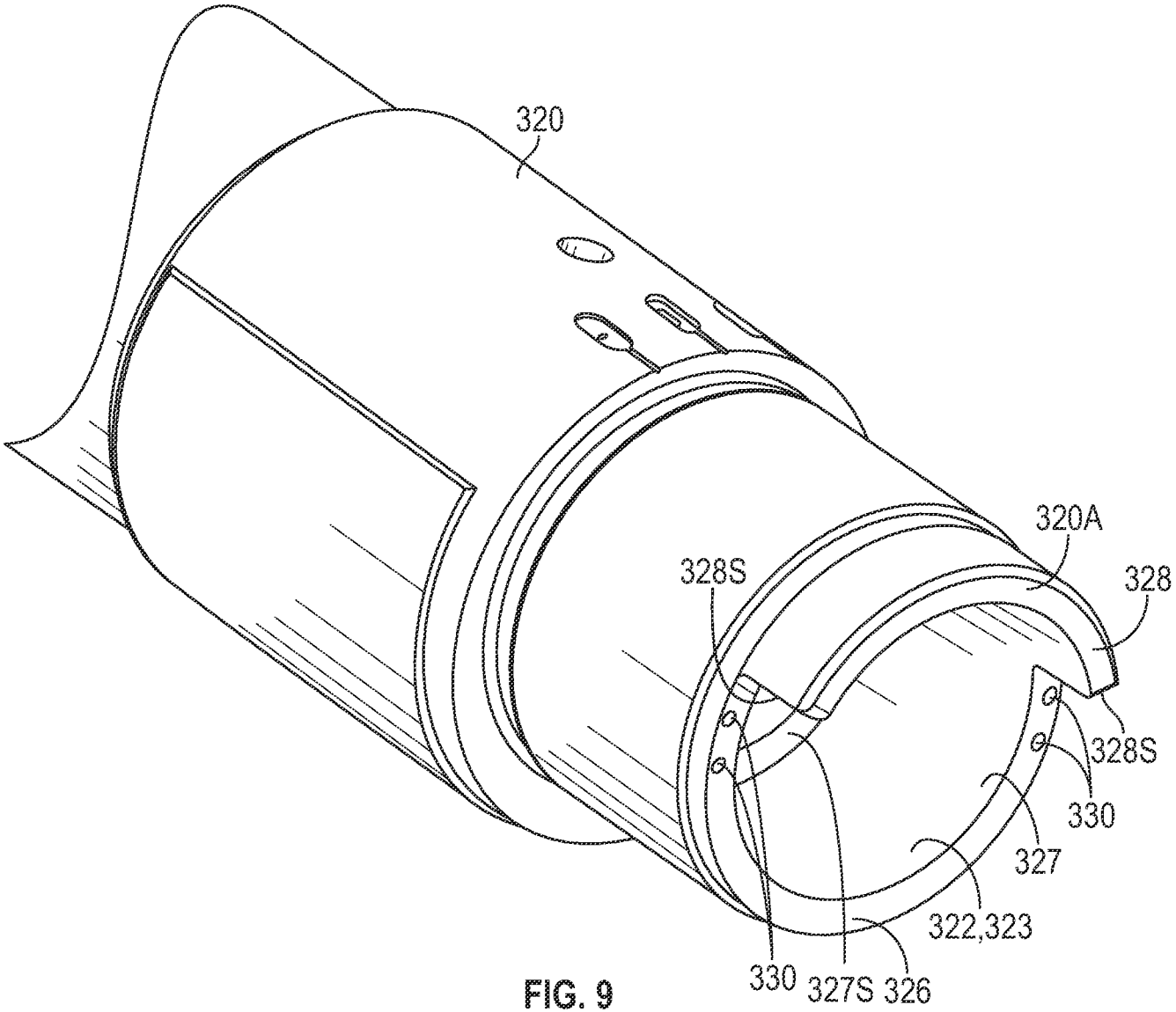
FIG. 9 is a perspective view of an embodiment of a lower offset housing of the bend adjustment assembly of FIG. 7.

As shown particularly in FIGS. 6, 7, and 9, the lower offset housing 320 of bend adjustment assembly 300 is generally tubular and has a first or upper end 320A, a second or lower end 320B, and a generally cylindrical inner surface 322 extending between ends 320A and 320B. A generally cylindrical outer surface of lower offset housing 320 includes a threaded connector coupled to the threaded connector of upper offset housing 310. The inner surface 322 of lower offset housing 320 includes an offset engagement surface 323 extending from upper end 320A to an internal shoulder 327S (shown in FIG. 9), and a threaded connector extending from lower end 320B. In this embodiment, offset engagement surface 323 defines an offset bore or passage 327 (shown in FIG. 9) that extends between upper end 320A and internal shoulder 327S of lower offset housing 320.

Additionally, lower offset housing 320 includes a central bore or passage 329 extending between lower end 320B and internal shoulder 327S, where central passage 329 has a central axis disposed at an angle relative to a central axis of offset bore 327. In other words, offset engagement surface 323 has a central or longitudinal axis that is offset or disposed at an angle relative to a central or longitudinal axis of lower offset housing 320. Thus, in this embodiment, the offset or angle formed between central bore 329 and offset bore 327 of lower offset housing 320 facilitates the formation of bend 101 described above. In this embodiment, the inner surface 322 of lower offset housing 320 additionally includes an internal lower annular shoulder 325 (shown in FIG. 7) positioned in central bore 329, and an internal upper annular shoulder 326 (shown in FIG. 9).

In this embodiment, lower offset housing 320 of bend adjustment assembly 300 includes an arcuate, axially extending locking member or shoulder 328 at upper end 320A. Particularly, locking shoulder 328 extends arcuately between a pair of axially extending shoulders 328S. In this embodiment, locking shoulder 328 extends less than 180° about the central axis of lower offset housing 320; however, in other embodiments, the arcuate length or extension of locking shoulder 328 may vary. Additionally, lower offset housing 320 includes a plurality of circumferentially spaced and axially extending ports 330. Particularly, ports 330 extend axially between internal shoulders 325, 326 of lower offset housing 320. As will be discussed further herein, ports 330 of lower offset housing 320 provide fluid communication through a generally annular compensation or locking chamber 395 (shown in FIG. 7) of bend adjustment assembly 300.

Figure 8:
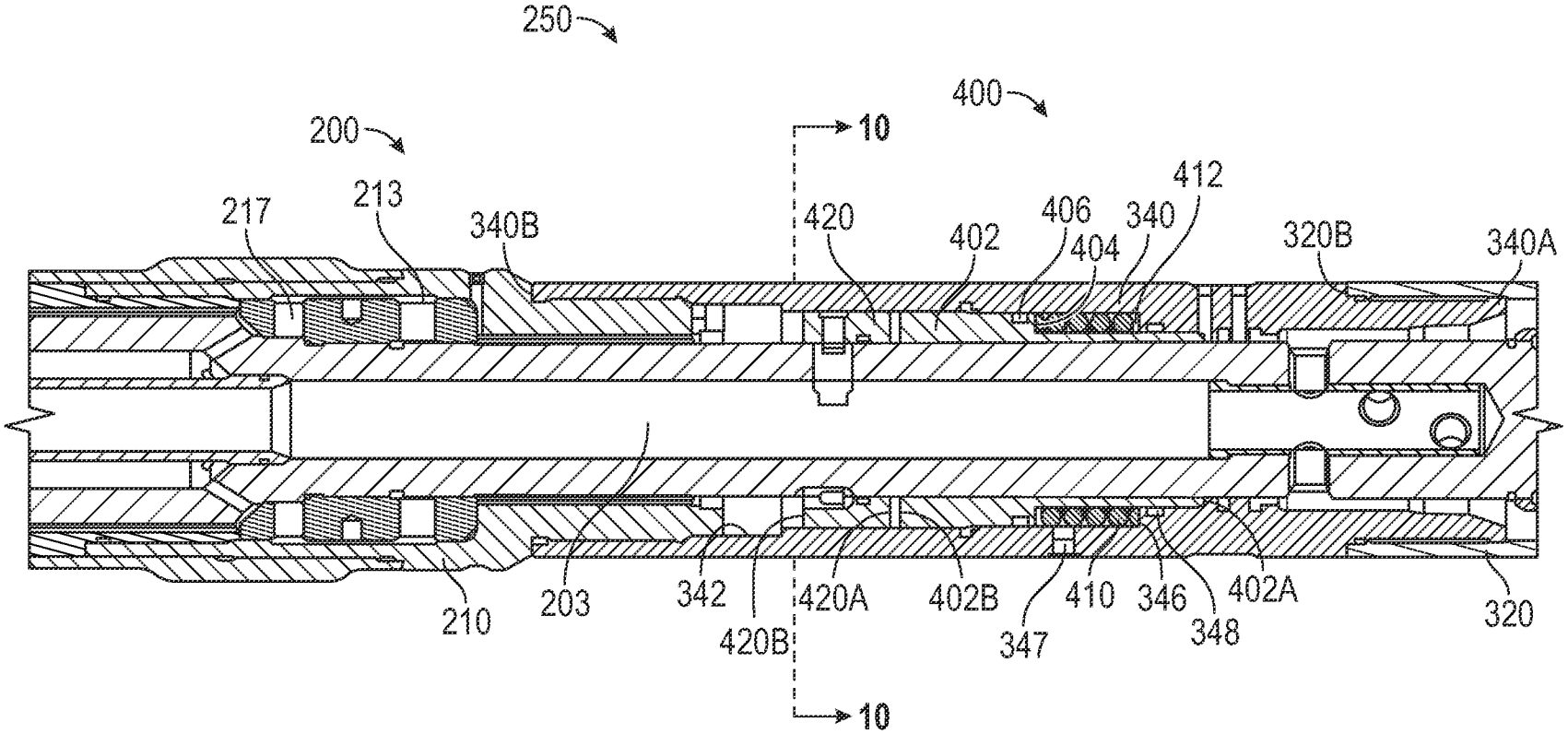
FIG. 8 is a side cross-sectional view of an embodiment of a bearing assembly of the mud motor of FIG. 6 in accordance with principles disclosed herein.
Figure 10:
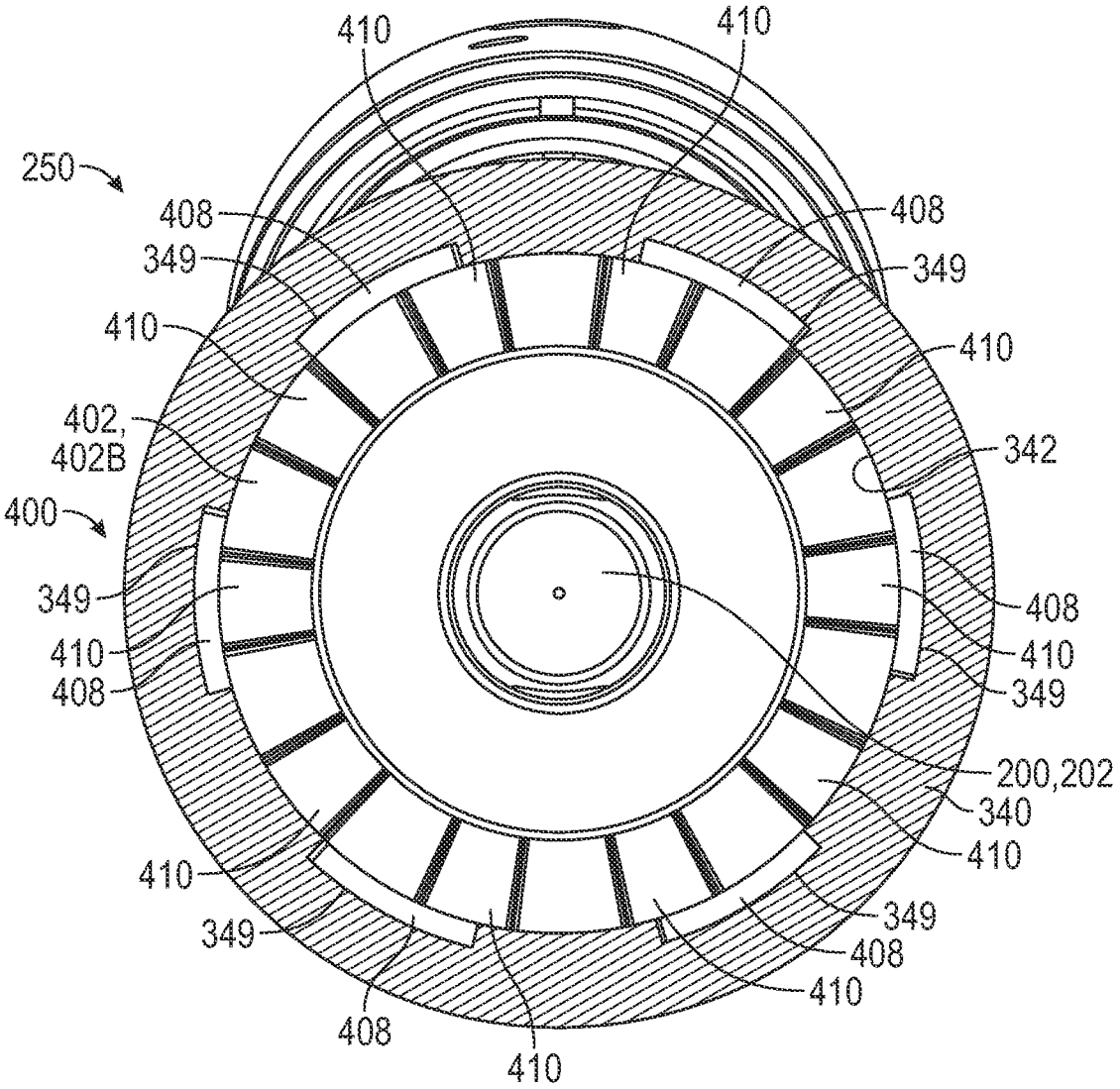
FIG. 10 is a cross-sectional view of the mud motor of FIG. 6 along line 10-10 of FIG. 8.

As shown particularly in FIGS. 8 and 10, actuator housing 340 of bend adjustment assembly 300 houses the locker assembly 400 of bend adjustment assembly 300 and threadably couples bend adjustment assembly 300 with bearing assembly 200. Actuator housing 340 is generally tubular and has a first or upper end 340A, a second or lower end 340B, and a central bore or passage defined by the generally cylindrical inner surface 342 extending between ends 340A and 340B. A generally cylindrical outer surface of actuator housing 340 includes a threaded connector at upper end 340A that is coupled with a threaded connector positioned at the lower end 320B of lower offset housing 320.

In this embodiment, the inner surface 342 of actuator housing 340 includes a threaded connector at lower end 340B, an annular shoulder 346, and a port 347 that extends radially between inner surface 342 and the outer surface of actuator housing 340.

A threaded connector positioned on the inner surface 342 of actuator housing 340 couples with a corresponding threaded connector disposed on an outer surface of bearing housing 210 at an upper end thereof to thereby couple bend adjustment assembly 300 with bearing assembly 200. In this embodiment, the inner surface 342 of actuator housing 340 additionally includes an annular seal 348 located proximal shoulder 346 and a plurality of circumferentially spaced and axially extending slots or grooves 349. As will be discussed further herein, seal 348 and slots 349 are configured to interface with components of locker assembly 400.

As shown particularly in FIG. 7, piston mandrel 350 of bend adjustment assembly 300 is generally tubular and has a first or upper end 350A, a second or lower end 350B, and a central bore or passage extending between ends 350A and 350B. Additionally, in this embodiment, piston mandrel 350 includes a generally cylindrical outer surface comprising an annular seal 352 located at upper end 350A that sealingly engages the inner surface of driveshaft housing 104". Further, piston mandrel 350 includes an annular shoulder 353 located proximal upper end 350A that physically engages or contacts an annular biasing member 354 extending about the outer surface of piston mandrel 350. In this embodiment, an annular compensating piston 356 is slidably disposed about the outer surface of piston mandrel 350. Compensating piston 356 includes a first or outer annular seal 358A disposed in an outer cylindrical surface of piston 356, and a second or inner annular seal 358B disposed in an inner cylindrical surface of piston 356, where inner seal 358B sealingly engages the outer surface of piston mandrel 350.

Also as shown particularly in FIG. 7, upper adjustment mandrel 360 of bend adjustment assembly 300 is generally tubular and has a first or upper end 360A, a second or lower end 360B, and a central bore or passage defined by a generally cylindrical inner surface extending between ends 360A and 360B. In this embodiment, the inner surface of upper adjustment mandrel 360 includes an annular recess 361 extending axially into mandrel 360 from upper end 360A, and an annular seal 362 axially spaced from recess 361 and configured to sealingly engage the outer surface of piston mandrel 350. In this embodiment, outer seal 358A of compensating piston 356 sealingly engages the inner surface of upper adjustment mandrel 360, restricting fluid communication between locking chamber 395 and a generally annular compensating chamber 359 formed about piston mandrel 350 and extending axially between seal 352 of piston mandrel 350 and outer seal 358A of compensating piston 356. In this configuration, compensating chamber 359 is in fluid communication with the surrounding environment (e.g., borehole 16) via ports 363 in driveshaft housing 104".

In this embodiment, upper adjustment mandrel 360 includes a generally cylindrical outer surface comprising a first or upper threaded connector, and an offset engagement surface 365. The upper threaded connector extends from upper end 360A and couples to a threaded connector disposed on the inner surface of driveshaft housing 104" at a lower end thereof. Offset engagement surface 365 has a central or longitudinal axis that is offset from or disposed at an angle relative to a central or longitudinal axis of upper adjustment mandrel 360. Offset engagement surface 365 matingly engages the engagement surface 316 of housing extension 310. In this embodiment, relative rotation is permitted between upper housing 302 and upper adjustment mandrel 360 while relative axial movement is restricted between housing 302 and mandrel 360.

Figure 11:
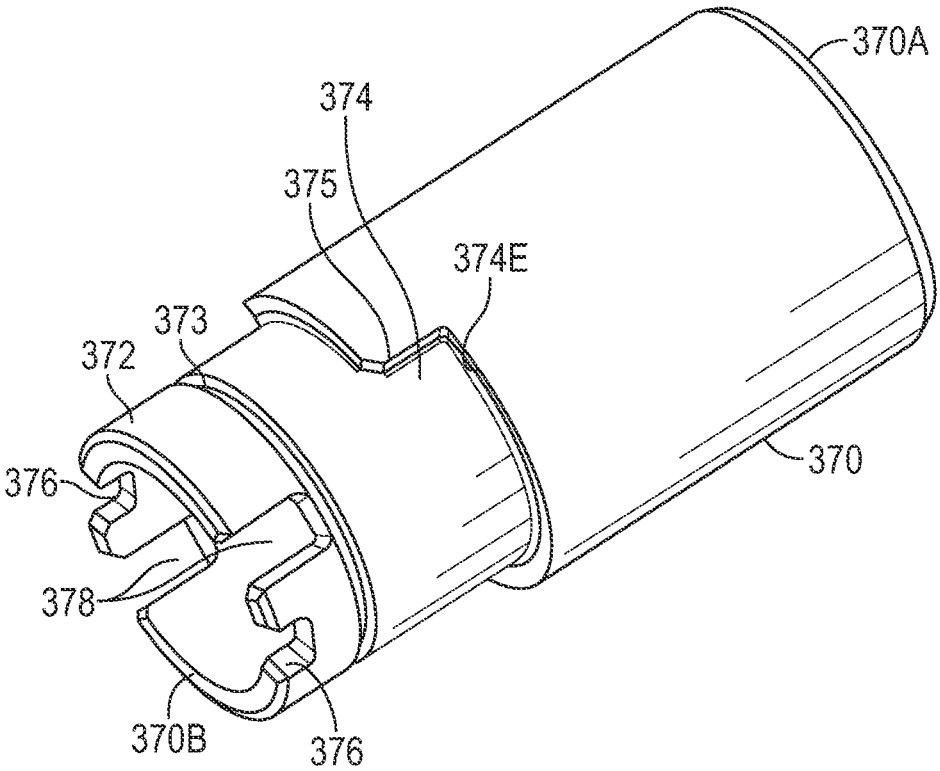
FIG. 11 is a perspective view of an embodiment of a lower adjustment mandrel of the bend adjustment assembly of FIG. 7 in accordance with principles disclosed herein.

As shown particularly in FIGS. 7, 11, lower adjustment mandrel 370 of bend adjustment assembly 300 is generally tubular and has a first or upper end 370A, a second or lower end 370B, and a central bore or passage extending therebetween that is defined by a generally cylindrical inner surface. In this embodiment, one or more splines 366 positioned radially between lower adjustment mandrel 370 and upper adjustment mandrel 360 restricts relative rotation between mandrels 360, 370. Additionally, lower adjustment mandrel 370 includes a generally cylindrical outer surface comprising an offset engagement surface 372, an annular seal 373, and an arcuately extending recess 374 (shown in FIG. 11). Offset engagement surface 372 has a central or longitudinal axis that is offset or disposed at an angle relative to a central or longitudinal axis of the upper end 360A of upper adjustment mandrel 360 and the lower end 320B of lower housing 320, where offset engagement surface 372 is disposed directly adjacent or overlaps the offset engagement surface 323 of lower housing 320. Additionally, the central axis of offset engagement surface 372 is offset or disposed at an angle relative to a central or longitudinal axis of lower adjustment mandrel 370. When bend adjustment assembly 300 is disposed in unbent position 303, a first deflection angle is provided between the central axis of lower housing 320 and the central axis of lower adjustment mandrel 370, and when bend adjustment assembly 300 is disposed in the bent position, a second deflection angle is provided between the central axis of lower housing 320 and the central axis 115 of driveshaft housing 104" that is different from the first deflection angle.

In this embodiment, an annular seal 373 is disposed in the outer surface of lower adjustment mandrel 370 to sealingly engage the inner surface of lower housing 320. In this embodiment, relative rotation is permitted between lower housing 320 and lower adjustment mandrel 370. Arcuate recess 374 is defined by an inner terminal end 374E and a pair of circumferentially spaced shoulders 375. In this embodiment, lower adjustment mandrel 370 further includes a pair of circumferentially spaced first or short slots 376 and a pair of circumferentially spaced second or long slots 378, where both short slots 376 and long slots 378 extend axially into lower adjustment mandrel 370 from lower end 370B. In this embodiment, each short slot 376 is circumferentially spaced approximately 180° apart. Similarly, in this embodiment, each long slot 378 is circumferentially spaced approximately 180° apart.

Figure 12:
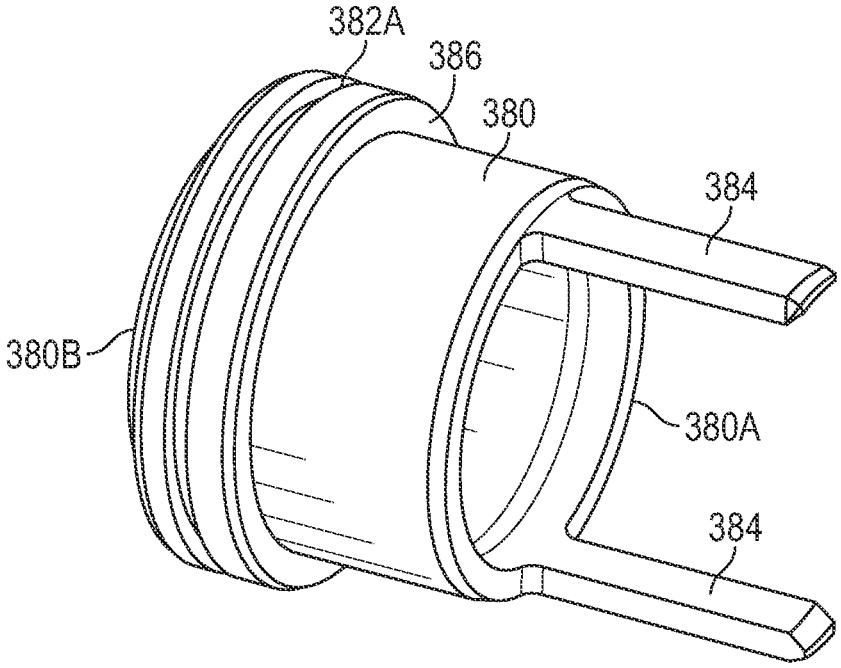
FIG. 12 is a perspective view of an embodiment of a locking piston of the bend adjustment assembly of FIG. 7 in accordance with principles disclosed herein.
Figure 13:
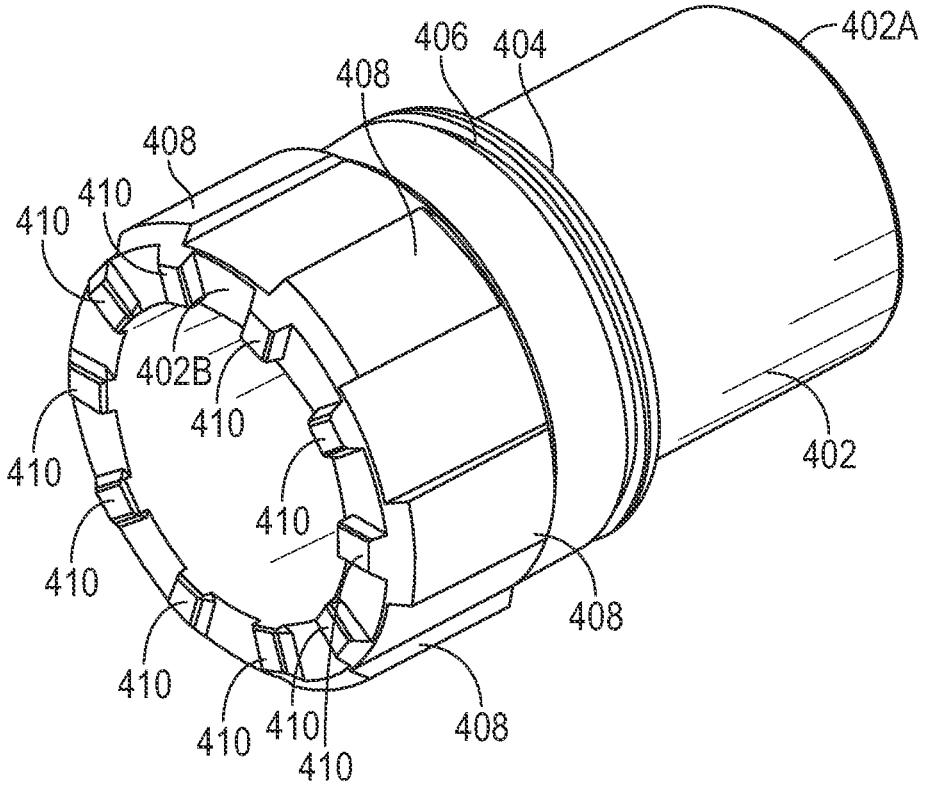
FIG. 13 is a perspective view of an embodiment of an actuator piston of the mud motor of FIG. 6 in accordance with principles disclosed herein.
Figure 14:
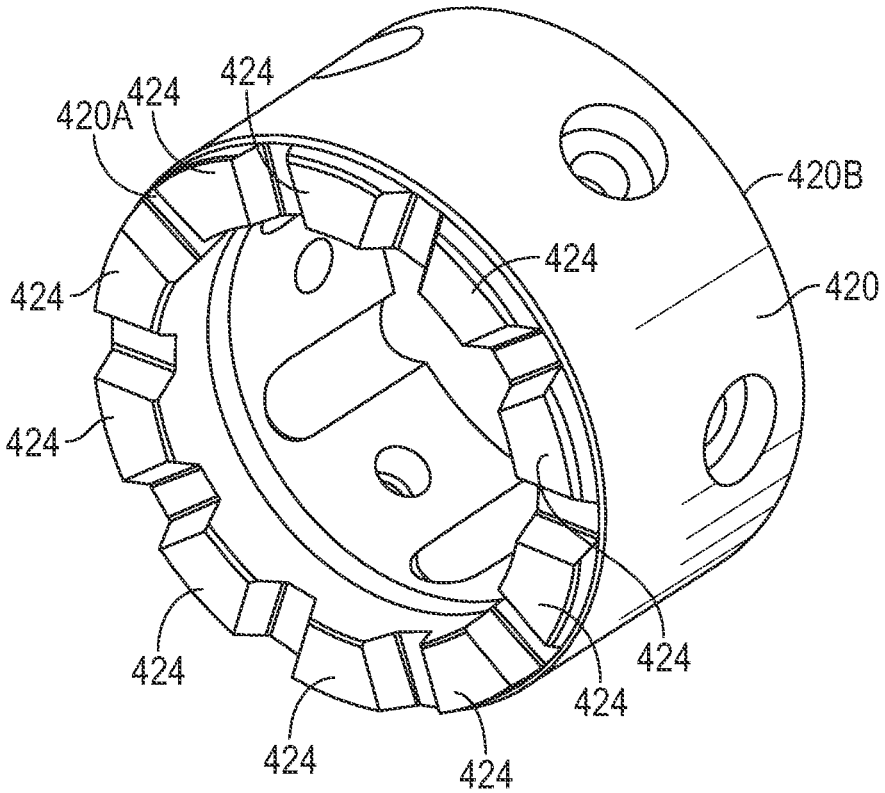
FIG. 14 is a perspective view of an embodiment of a torque transmitter of the mud motor of FIG. 6 in accordance with principles disclosed herein.

As shown particularly in FIGS. 7, 12, locking piston 380 of bend adjustment assembly 300 is generally tubular and has a first or upper end 380A, a second or lower end 380B, and a central bore or passage extending therebetween. Locking piston 380 includes a generally cylindrical outer surface comprising a pair of annular seals 382A, 382B (seal 382B hidden for clarity in FIG. 12) disposed therein. In this embodiment, locking piston 380 includes a pair of circumferentially spaced keys 384 that extend axially from upper end 380A, where each key 384 extends through one of a pair of circumferentially spaced slots formed in the inner surface 322 of lower housing 320. In this arrangement, relative rotation between locking piston 380 and lower housing 320 is restricted while relative axial movement is permitted therebetween. As will be discussed further herein, each key 384 is receivable in either one of the short slots 376 or long slots 378 of lower adjustment mandrel 370 depending on the relative angular position between locking piston 380 and lower adjustment mandrel 370. In this embodiment, the outer surface of locking piston 380 includes an annular shoulder 386 positioned between annular seals 382A, 382B. In this embodiment, engagement between locking piston 380 and lower adjustment mandrel 370 serves to selectively restrict relative rotation between lower adjustment mandrel 370 and lower housing 320; however, in other embodiments, lower housing 320 includes one or more features (e.g., keys, etc.) receivable in slots 376, 378 to selectively restrict relative rotation between lower adjustment mandrel 370 and lower housing 320.

In this embodiment, the combination of sealing engagement between seals 382A, 382B of locking piston 380 and the inner surface 322 of lower housing 320, defines a lower axial end of locking chamber 395. Locking chamber 395 extends longitudinally from the lower axial end thereof to an upper axial end defined by the combination of sealing engagement between the outer seal 358A of compensating piston 356 and the inner seal 358B of piston 356. Particularly, lower adjustment mandrel 370 and upper adjustment mandrel 360 each include axially extending ports, including ports 368 formed in upper adjustment mandrel 360, similar in configuration to the ports 330 of lower housing 320 such that fluid communication is provided between the annular space directly adjacent shoulder 386 of locking piston 380 and the annular space directly adjacent a lower end of compensating piston 356. Locking chamber 395 is sealed such that drilling fluid flowing through mud motor 250 to drill bit 90 is not permitted to communicate with fluid disposed in locking chamber 395, where locking chamber 395 is filled with lubricant (e.g., an oil-based lubricant).

As shown particularly in FIGS. 8, 10, 13, and 14, locker assembly 400 of bend adjustment assembly 300 generally includes an actuator piston 402 and a torque transmitter or teeth ring 420. Actuator piston 402 is slidably disposed about bearing mandrel 202 and has a first or upper end 402A, a second or lower end 402B, and a central bore or passage extending therebetween. In this embodiment, actuator piston 402 has a generally cylindrical outer surface including an annular shoulder 404 and an annular seal 406 located axially between shoulder 404 and lower end 402B. The outer surface of actuator piston 402 includes a plurality of radially outwards extending and circumferentially spaced keys 408 (shown in FIG. 10) received in the slots 349 of actuator housing 340. In this arrangement, actuator piston 402 is permitted to slide axially relative actuator housing 340 while relative rotation between actuator housing 340 and actuator piston 402 is restricted. Additionally, in this embodiment, actuator piston 402 includes a plurality of circumferentially spaced locking teeth 410 extending axially from lower end 402B.

In this embodiment, seal 406 of actuator piston 402 sealingly engages the inner surface 342 of actuator housing 340 and an annular seal positioned on an inner surface of teeth ring 420 sealingly engages the outer surface of bearing mandrel 202. Additionally, the seal 348 of actuator housing 340 sealingly engages the outer surface of actuator piston 402 to form an annular, sealed compensating chamber 412 extending therebetween. Fluid pressure within compensating chamber 410 is compensated or equalized with the surrounding environment (e.g., borehole 16) via port 347 of actuator housing 340. Additionally, an annular biasing member 412 is disposed within compensating chamber 410 and applies a biasing force against shoulder 404 of actuator piston 402 in the axial direction of teeth ring 420. Teeth ring 420 of locker assembly 400 is generally tubular and comprises a first or upper end 420A, a second or lower end 420B, and a central bore or passage extending between ends 420A and 420B. Teeth ring 420 is coupled to bearing mandrel 202 via a plurality of circumferentially spaced splines or pins disposed radially therebetween. In this arrangement, relative axial and rotational movement between bearing mandrel 202 and teeth ring 420 is restricted. Additionally, in this embodiment, teeth ring 420 comprises a plurality of circumferentially spaced teeth 424 extending from upper end 420A. Teeth 424 of teeth ring 420 are configured to matingly engage or mesh with the teeth 410 of actuator piston 402 when biasing member 412 biases actuator piston 402 into contact with teeth ring 420, as will be discussed further herein.

As shown particularly in FIG. 8, in this embodiment, locker assembly 400 is both mechanically and hydraulically biased during operation of mud motor 250. Additionally, the driveline of mud motor 250 is independent of the operation of locker assembly 400 while drilling, thereby permitting 100% of the available torque provided by power section 40 to power drill bit 90 when locker assembly 400 is disengaged. The disengagement of locker assembly 400 may occur at high flowrates through mud motor 250, and thus, when higher hydraulic pressures are acting against actuator piston 402. Additionally, in some embodiments, locker assembly 400 may be used to rotate something parallel to bearing mandrel 202 instead of being used like a clutch to interrupt the main torque carrying driveline of mud motor 35. In this configuration, locker assembly 400 comprises a selective auxiliary drive that is simultaneously both mechanically and hydraulically biased. Further, this configuration of locker assembly 400 allows for various levels of torque to be applied as the hydraulic effect can be used to effectively reduce the preload force of biasing member 412 acting on mating teeth ring 420. This type of angled tooth clutch may be governed by the angle of the teeth (e.g., teeth 424 of teeth ring 420), the axial force applied to keep the teeth in contact, the friction of the teeth ramps, and the torque engaging the teeth to determine the slip torque that is required to have the teeth slide up and turn relative to each other.

In some embodiments, locker assembly 400 permits rotation in mud motor 250 to rotate rotor 50 and bearing mandrel 202 until bend adjustment assembly 300 has fully actuated, and then, subsequently, ratchet or slip while transferring relatively large amounts of torque to bearing housing 210. This reaction torque may be adjusted by increasing the hydraulic force or hydraulic pressure acting on actuator piston 402, which may be accomplished by increasing flowrate through mud motor 250. When additional torque is needed a lower flowrate or fluid pressure can be applied to locker assembly 400 to modulate the torque and thereby rotate bend adjustment assembly 300. The fluid pressure is transferred to actuator piston 402 by compensating piston 226. In some embodiments, the pressure drop across drill bit 90 may be used to increase the pressure acting on actuator piston 402 as flowrate through mud motor 250 is increased. Additionally, ratcheting of locker assembly 400 once bend adjustment assembly 300 reaches a fully bent position may provide a relatively high torque when teeth 424 are engaged and riding up the ramp and a very low torque when locker assembly 400 ratchets to the next tooth when the slipping torque value has been reached (locker assembly 400 catching again after it slips one tooth of teeth 424). This behavior of locker assembly 400 may provide a relatively good pressure signal indicator that bend adjustment assembly 300 has fully actuated and is ready to be locked.

As described above, bend adjustment assembly 300 includes unbent position 303 and a bent position providing deflection angle θ. In this embodiment, central axis 105 of driveshaft housing 104" is parallel with, but laterally offset from central axis 215 of bearing mandrel 202 when bend adjustment assembly 300 is in unbent position 303; however, in other embodiments, driveshaft housing 104" may comprise a fixed bent housing providing an angle between axes 115 and 215 when bend adjustment assembly 300 is in unbent position 303. Locker assembly 400 is configured to control or facilitate the downhole or in-situ actuation or movement of bend adjustment assembly between unbent position 303 and the bent position. As will be described further herein, in this embodiment, bend adjustment assembly 300 is configured to shift from unbent position 303 to the bent position in response to rotation of lower housing 320 in a first direction relative to lower adjustment mandrel 370, and shift from the bent position to the unbent position 303 in response to rotation of lower housing 320 in a second direction relative to lower adjustment mandrel 370 that is opposite the first direction.

Still referring to FIGS. 1, 6-14, in this embodiment, bend adjustment assembly 300 may be actuated unbent position 303 and the bent position via rotating offset housings 310 and 320 relative adjustment mandrels 360 and 370 in response to varying a flowrate of drilling fluid through mud motor 250 and/or varying the degree of rotation of drillstring 21 at the surface. Particularly, locking piston 380 includes a first or locked position restricting relative rotation between offset housings 310, 320, and adjustment mandrels 360, 370, and a second or unlocked position axially spaced from the locked position that permits relative rotation between housings 310, 320, and adjustment mandrels 360, 370. In the locked position of locking piston 380, keys 384 are received in either short slots 376 or long slots 378 of lower adjustment mandrel 370, thereby restricting relative rotation between locking piston 380, which is not permitted to rotate relative lower housing 320, and lower adjustment mandrel 370. In the unlocked position of locking piston 380, keys 384 of locking piston 380 are not received in either short slots 376 or long slots 378 of lower adjustment mandrel 370, and thus, rotation is permitted between locking piston 380 and lower adjustment mandrel 370. Additionally, in this embodiment, bearing housing 210, actuator housing 340, lower housing 320, and upper housing 310 are threadably connected to each other. Similarly, lower adjustment mandrel 370, upper adjustment mandrel 360, and driveshaft housing 104" are each threadably connected to each other in this embodiment. Thus, relative rotation between offset housings 310, 320, and adjustment mandrels 360, 370, results in relative rotation between bearing housing 210 and driveshaft housing 104".

As described above, offset bore 327 and offset engagement surface 323 of lower housing 320 are offset from central bore 329 and the central axis of housing 320 to form a lower offset angle, and offset engagement surface 365 of upper adjustment mandrel 360 is offset from the central axis of mandrel 360 to form an upper offset angle. Additionally, offset engagement surface 323 of lower housing 320 matingly engages the engagement surface 372 of lower adjustment mandrel 370 while the engagement surface 314 of housing extension 310 matingly engages the offset engagement surface 365 of upper adjustment mandrel 360. In this arrangement, the relative angular position between lower housing 320 and lower adjustment mandrel 370 determines the total offset angle (ranging from 0° to a maximum angle greater than 0°) between the central axes of lower housing 320 and driveshaft housing 104".

The minimum angle (0° in this embodiment) occurs when the upper and lower offsets are in-plane and cancel out, while the maximum angle occurs when the upper and lower offsets are in-plane and additive. Therefore, by adjusting the relative angular positions between offset housings 310, 320, and adjustment mandrels 360, 370, the deflection angle θ and bend 101 of bend adjustment assembly 300 may be adjusted or manipulated in-turn. The magnitude of bend 101 is controlled by the relative positioning of shoulders 328S and shoulders 375, which establish the extents of angular rotation in each direction. In this embodiment, lower housing 320 is provided with a fixed amount of spacing between shoulders 328S, while adjustment mandrel 370 can be configured with an optional amount of spacing between shoulders 375, allowing the motor to be set up with the desired bend setting options as dictated by a particular job simply by providing the appropriate configuration of lower adjustment mandrel 370.

Also as described above, locker assembly 400 is configured to control the actuation of bend adjustment assembly 300, and thereby, control the degree of bend 101. In this embodiment, locker assembly 400 is configured to selectively or controllably transfer torque from bearing mandrel 202 (supplied by rotor 50) to actuator housing 340 in response to changes in the flowrate of drilling fluid supplied to power section 40. Particularly, in this embodiment, to actuate bend adjustment assembly 300 from unbent position 303 to the bent position, the pumping of drilling mud from surface pump 23 and the rotation of drillstring 21 by rotary system 24 is ceased. Particularly, the pumping of drilling mud from surface pump 23 is ceased for a predetermined first time period. In some embodiments, the first time period over which pumping is ceased from surface pump 23 comprises approximately 15-120 seconds; however, in other embodiments, the first time period may vary. With the flow of drilling fluid to power section 40 ceased during the first time period, fluid pressure applied to the lower end 380B of locking piston 380 (from drilling fluid in annulus 116) is reduced, while fluid pressure applied to the upper end 380A of piston 380 is maintained, where the fluid pressure applied to upper end 380A is from lubricant disposed in locking chamber 395 that is equalized with the fluid pressure in borehole 16 via ports 114 and locking piston 356. With the fluid pressure acting against lower end 380B of locking piston 380 reduced, the biasing force applied to the upper end 380A of piston 380 via biasing member 354 (the force being transmitted to upper end 380A via the fluid disposed in locking chamber 395) is sufficient to displace or actuate locking piston 380 from the locked position with keys 384 received in long slots 378 of lower adjustment mandrel 370, to the unlocked position with keys 384 free from long slots 378, thereby unlocking offset housings 310, 320, from adjustment mandrels 360, 370. In this manner, locking piston 380 comprises a first locked position with keys 384 receives in short slots 376 of lower adjustment mandrel 370 and a second locked position, which is axially spaced from the first locked position, with keys 384 receives in long slots 378 of lower adjustment mandrel 370.

In this embodiment, directly following the first time period, surface pump 23 resumes pumping drilling mud into drillstring 21 at a first flowrate that is reduced by a predetermined percentage from a maximum mud flowrate of well system 10, where the maximum mud flowrate of well system 10 is dependent on the application, including the size of drillstring 21 and BHA 30. For instance, the maximum mud flowrate of well system 10 may comprise the maximum mud flowrate that may be pumped through drillstring 21 and BHA 30 before components of drillstring 21 and/or BHA 30 are eroded or otherwise damaged by the mud flowing therethrough. In some embodiments, the first flowrate of drilling mud from surface pump 23 comprises approximately 1%-30% of the maximum mud flowrate of well system 10; however, in other embodiments, the first flowrate may vary. For instance, in some embodiments, the first flowrate may comprise zero or substantially zero fluid flow. In this embodiment, surface pump 23 continues to pump drilling mud into drillstring 21 at the first flowrate for a predetermined second time period while rotary system 24 remains inactive. In some embodiments, the second time period comprises approximately 15-120 seconds; however, in other embodiments, the second time period may vary.

During the second time period with drilling mud flowing through BHA 30 from drillstring 21 at the first flowrate, rotational torque is transmitted to bearing mandrel 202 via rotor 50 of power section 40 and driveshaft 106. Additionally, biasing member 412 applies a biasing force against shoulder 404 of actuator piston 402 to urge actuator piston 402 into contact with teeth ring 420, with teeth 410 of piston 402 in meshing engagement with the teeth 424 of teeth ring 420. In this arrangement, torque applied to bearing mandrel 202 is transmitted to actuator housing 340 via the meshing engagement between teeth 424 of teeth ring 420 (rotationally fixed to bearing mandrel 202) and teeth 410 of actuator piston 402 (rotationally fixed to actuator housing 340). Rotational torque applied to actuator housing 340 via locker assembly 400 is transmitted to offset housings 310, 320, which rotate (along with bearing housing 210) in a first rotational direction relative adjustment mandrels 360, 370. Particularly, extension 328 of lower housing 320 rotates through arcuate recess 374 of lower adjustment mandrel 370 until a shoulder 328S engages a corresponding shoulder 375 of recess 374, restricting further relative rotation between offset housings 310, 320, and adjustment mandrels 360, 370. Following the rotation of lower housing 320, bend adjustment assembly 300 is disposed in the bent position providing bend 101. Additionally, although during the actuation of bend adjustment assembly 300 drilling fluid flows through mud motor 250 at the first flowrate, the first flowrate is not sufficient to overcome the biasing force provided by biasing member 354 against locking piston 380 to thereby actuate locking piston 380 back into the locked position.

In this embodiment, directly following the second time period, with bend adjustment assembly 300 disposed in the bent position, the flowrate of drilling mud from surface pump 23 is increased from the first flowrate to a second flowrate that is greater than the first flowrate. In some embodiments, the second flowrate of drilling mud from surface pump 23 comprises approximately 50%-100% of the maximum mud flowrate of well system 10; however, in other embodiments, the second flowrate may vary. Following the second time period with drilling mud flowing through BHA 30 from drillstring 21 at the second flowrate, the fluid pressure applied to the lower end 380B of locking piston 380 is sufficiently increased to overcome the biasing force applied against the upper end 380A of piston 380 via biasing member 354, actuating or displacing locking piston 380 from the unlocked position to the locked position with keys 384 received in short slots 376, thereby rotationally locking offset housings 310, 320, with adjustment mandrels 360, and 370.

Additionally, with drilling mud flowing through BHA 30 from drillstring 21 at the second flowrate, fluid pressure applied against the lower end 402B of actuator piston 402 from the drilling fluid (such as through leakage of the drilling fluid in the space disposed radially between the inner surface of actuator piston 402 and the outer surface of bearing mandrel 202) is increased, overcoming the biasing force applied against shoulder 404 by biasing member 412 and thereby disengaging actuator piston 402 from teeth ring 420. With actuator piston 402 disengaged from teeth ring 420, torque is no longer transmitted from bearing mandrel 202 to actuator housing 340. In some embodiments, as borehole 16 is drilled with bend adjustment assembly 300 in the bent position, additional pipe joints may need to be coupled to the upper end of drillstring 21, necessitating the stoppage of the pumping of drilling fluid to power section 40 from surface pump 23. In some embodiments, following such a stoppage, the steps described above for actuating bend adjustment assembly 300 into the bent position may be repeated to ensure that assembly 300 remains in the bent position.

On occasion, it may be desirable to actuate bend adjustment assembly 300 from the bent position to the unbent position 303. In this embodiment, bend adjustment assembly 300 is actuated from the bent position to the unbent position 303 by ceasing the pumping of drilling fluid from surface pump 23 for a predetermined third period of time. Either concurrent with the third time period or following the start of the third time period, rotary system 24 is activated to rotate drillstring 21 at a first or actuation rotational speed for a predetermined fourth period of time. In some embodiments, both the third time period and the fourth time period each comprise approximately 15-120 seconds; however, in other embodiments, the third time period and the fourth time period may vary. Additionally, in some embodiments, the rotational speed comprises approximately 1-30 revolutions per minute (RPM) of drillstring 21; however, in other embodiments, the actuation rotational speed may vary. During the fourth time period, with drillstring 21 rotating at the actuation rotational speed, reactive torque is applied to bearing housing 210 via physical engagement between an outer surface of bearing housing 210 and the sidewall 19 of borehole 16, thereby rotating bearing housing 210 and offset housings 310, 320, relative to adjustment mandrels 360, 370 in a second rotational direction opposite the first rotational direction described above. Rotation of lower housing 320 causes shoulder 328 to rotate through recess 374 of lower adjustment mandrel 370 until a shoulder 328S physically engages a corresponding shoulder 375 of recess 374, restricting further rotation of lower housing 320 in the second rotational direction.

In this embodiment, following the third and fourth time periods (the fourth time period ending either at the same time as the third time period or after the third time period has ended), with bend adjustment assembly 300 disposed in the unbent position 303, drilling mud is pumped through drillstring 21 from surface pump 23 at a third flowrate for a predetermined fifth period of time while drillstring 21 is rotated by rotary system 24 at the actuation rotational speed. In some embodiments, the fifth period of time comprises approximately 15-120 second and the third flowrate of drilling mud from surface pump 23 comprises approximately 30%-80% of the maximum mud flowrate of well system 10; however, in other embodiments, the firth period of time and the third flowrate may vary.

Following the fifth period of time, the flowrate of drilling mud from surface pump 23 is increased from the third flowrate to a flowrate near or at the maximum mud flowrate of well system 10 to thereby disengage locker assembly 400 and dispose locking piston 380 in the locked position. Once surface pump 23 is pumping drilling mud at the drilling or maximum mud flowrate of well system 10, rotation of drillstring 21 via rotary system 24 may be ceased or continued at the actuation rotational speed. With drilling mud being pumped into drillstring 21 at the third flowrate and the drillstring 21 being rotated at the actuation rotational speed, locker assembly 400 is disengaged and locking piston 380 is disposed in the locked position with keys 384 received in long slots 378 of lower adjustment mandrel 370.

With locker assembly 300 disengaged and locking piston 380 disposed in the locked position drilling of borehole 16 via BHA 30 may be continued with surface pump 23 pumping drilling mud into drillstring 21 at or near the maximum mud flowrate of well system 10. In other embodiments, instead of surface pump 23 at the third flowrate for a period of time following the third and fourth time periods, surface pump 23 may be operated immediately at 100% of the maximum mud flowrate of well system 10 to disengage locker assembly 400 and dispose locking piston 380 in the locked position. Once surface pump 23 is pumping drilling mud at the drilling or maximum mud flowrate of well system 10, rotation of drillstring 21 via rotary system 24 may be ceased or continued at the actuation rotational speed.

In certain embodiments, electronics package 125 of mud motor 250 provides for the ability to confirm the position of and/or actuate the bend adjustment assembly 300 of mud motor 250 between unbent position 303 and the bent positions electronically with wired connections that can pass power to downhole electric hydraulic pumps and solenoids positioned in mud motor 250. In some embodiments, bend adjustment assembly 300 is actuated from the surface via electronics package 125 using a downlinking method, such as the downlinking method described in U.S. Pat. No. 9,488,045, which is incorporated herein by reference for all of its teachings. In some embodiments, electronics package 125 can be replaced with electronics package 138 to provide added functionality as described above. This added functionality could be real-time measurements of the adjustable sensors to be passed to a MWD tools above mud motor 250. In certain embodiments, electronics package 125 of mud motor 250 comprises a puck with a recess or a spacer ring placed on top of the puck to allow a thrust piece of driveshaft 106 to be placed properly. In some embodiments, electronics package 125 comprises a BlackBoxHD, BlackBox Eclipse and Blackbox EMS provided by National Oilwell Varco located at 7909 Parkwood Circle Drive, Houston, Texas 77036. In some embodiments, electronics package 125 includes features in common with the electronics packages and sensor assemblies described in U.S. Pat. No. 8,487,626, which is incorporated herein by reference for all of its teachings.

In some embodiments, electronics package 125 comprises a pressure data logger electronics board with one or two pressure sensors coupled to driveshaft adapter 120 to allow seal boot pressure, downhole pressure and bit drop pressures to all be monitored. By extending a passage to a bore of rotor 50 of mud motor 250 and passing wires to an additional pressure sensor mounted on the upper end 120A of the driveshaft adapter 120, internal differential pressure across mud motor 250 may be obtained. This is accomplished as the inner diameter of the rotors pressure would give the pressure at the top of rotor 50. Additionally, if the second pressure sensor takes a pressure reading of the seal boot pressure then a differential pressure across the rotor 50 of mud motor 250 may be obtained. By knowing the differential pressure across the rotor 50, a relatively accurate estimate of the torque output of the power section 40 of mud motor 250 may be determined. Particularly, each power section of a mud motor (e.g., power section 40 of mud motor 250) has a performance chart where a specific pressure across the rotor equals a specific torque output. Alternately, in some embodiments, the center of the rotor 50 of mud motor 250 could be used to house batteries when a ported rotor is not needed and the wires leading up to the upper end of driveshaft adapter 120 could use a connector that would allow the batteries to be slid into the bore of the rotor 50 from the up hole side and then capped off with a sealing cap to house more power consuming electronics for formation logging or surveying as described in FIG. 5.

Alternately, the lengthened driveshaft adapter 132 shown in FIG. 5 could be used with mud motor 250, instead of using a DDL or BB puck (e.g., electronics package 125) as with the embodiment of FIG. 4. By providing a lengthened driveshaft adapter 132, a large receptacle 134 may be created to house electronics package 138 and used in mud motor 250 since the bend is positioned generally by lower universal joint 110B. In some embodiments, receptacle 134 of driveshaft adapter 132 could be used to place magnetometers and accelerometer sensors to allow near bit inclination/azimuth, RPM, and vibration readings to be recorded and then transmitted via an electromagnetic short hop transmitter to a MWD tool placed directly above mud motor 130 or 250. This would allow motors to have near bit measurements for inclination, something currently not in the field with the exception of RSS tools. Additionally, the cavity wall thickness could meet the hydrostatic pressure and torsional limits using the current DDL electronics package (e.g., electronics package 125) seals and dimensions. Placement of electronics (e.g., electronics packages 125, 138) in a receptacle (e.g., receptacles 124, 134) of the driveshaft adapter (e.g., driveshaft adapters 120, 132) does not increase the bit-to-bend of the mud motor (e.g., mud motors 250, 130) and has a smaller effect on the mud motor's build rate in this configuration.

The addition of electronic sensors in universal joint 110A and/or in the driveshaft adapter (e.g., driveshaft adapters 120, 132) followed by a wire exiting the top of the driveshaft adapter could allow placement of a short hop transmitter (e.g., as part of electronics package 138) positioned near bit (e.g., within 10 feet of drill bit 90 in some applications). The batteries used to power the short hop transmitter could be housed inside the rotor of mud motor 250 and connected to the wire exiting the top of the driveshaft adapter 132. Additionally, an antennae or transmitter could be stacked above the rotor 50 of mud motor 250 in a modified rotor catch with antennae inside in order to decrease the overall length of the short hop transmitter's unconnected jump distance to the MWD tool disposed above the mud motor which would be located directly above the mud motor. The ability to log torque, total RPM of drill bit 90, differential pressures, seal boot pressures, vibration, stick slip, and communicate with MWD tools positioned above mud motor 250 would further lessen any potential advantages RSS tools have over mud motors. A standard mud motor 130 or a downhole-adjustable mud motor (e.g., downhole-adjustable mud motor 250) with electronic logging (via electronics package 125) and/or downhole transmission (via electronics package 138) using a MWD tool positioned above the mud motor for telemetry could offer substantial cost savings relative to RSS tools offering similar functionality while providing additional data RSS systems typically cannot supply such as total torque output.

Referring to FIGS. 15-18, another embodiment of a mud motor 500 for use with the well system 10 of FIG. 1 is shown. Mud motor 500 is similar in configuration to the mud motor 250 described above but includes a bend adjustment assembly 505 comprising additional sensors/electronics that provides additional functionality. Sensors of mud motor 500 may communicate uphole via WDP joints and electrical connectors or coils (e.g., electromagnetic connections of WDP joints) 501 disposed between tool body connections to pass signals on the functions of mud motor 500 and associated components including oil bath health or bearing pack oil volume. In this embodiment, tool bodies or housings of mud motor 500 include axial passages which house electrical wires or cables 502 that extend between the electrical connectors or coils 501 of each tool body or housing connection.

In some embodiments, sensors placed in bend adjustment assembly 505 may indicate the bend setting of mud motor 500 so the operator would know electronically what position the mud motor 500 is in. In the embodiment of FIGS. 15-18, this functionality can be provided by placing proximity, Hall effect, optical sensors/encoders, and/or linear variable differential transformer (LVDT) sensor packages 504 in an upper offset housing 360 of bend adjustment assembly 505. Additionally sensor packages 504 (shown in FIG. 16, 17) may be placed in the upper housing 302 and/or a lower offset housing 320 of bend adjustment assembly 505 and used to determine the position of mud motor 500 as well by proximity sensors (of the sensor packages 504) referencing a lug position of a lower offset mandrel 370, or the axial position of lock piston 380 of bend adjustment assembly 505, could be done using Hall effects sensors as well.

The oil reservoir health for bend adjustment assembly 505 could also be checked using pressure sensors, LVDT, and proximity sensors of sensor packages 504 to determine the location of compensating piston 356 relative to the upper offset housing 360. If compensating piston 356 came into contact with the proximity sensor of the upper sensor package 504 of housing 360, the upper sensor package 504 would indicate that bend adjustment assembly 505 had lost oil during operation. If the pressure in this section was equal to the well bore pressure the user would also know the seals and oil bath had been compromised in this section of mud motor 500. Placing sensor packages 504 in upper offset housing 360 would cover both a "straight-to-bent" two-position configuration of mud motor 500 as well as a three position configuration of mud motor 500.

In this embodiment, the sensor packages 504 of actuator housing 340 (shown in FIG. 18) provides the position (activated or deactivated) of actuator piston 402 of bend adjustment assembly 505. Additionally the volume of oil and pressure of the oil bath surrounding the locker piston and bearing assembly of mud motor 500 could be used to determine the "health" of mud motor 500 during operation. Particularly, these measurements could be obtained by including proximity, Hall effects, LVDT and force sensors in the sensor packages 504 of actuator housing 340 (shown in FIG. 18) of bend adjustment assembly 505 (surrounding actuator piston 402). The ability to know if the locker assembly of mud motor 500 is functioning correctly and the amount of oil left in bearing assembly 200 would be useful to know in the field to make decisions should problems arise or if the run duration changed unexpectedly while drilling. Knowing these two pieces of information would aid in troubleshooting as well. The addition of sensor packages 504 to mud motor 500 also allows an electronics package or printed circuit board (PCB) to keep track of the number of bend position shifts (the number of times the bend setting of mud motor 500 is adjusted) mud motor 500 makes during a single run into borehole 16. The temperature of the locker assembly oil bath could also be monitored via internal pressure and temperature sensors 506 to detect locker assembly and bearing assembly 200 issues that could happen during the operation of mud motor 500. In this embodiment, mud motor 500 also includes external pressure and temperature sensors 510 for measuring conditions in borehole 16.

Figure 17:
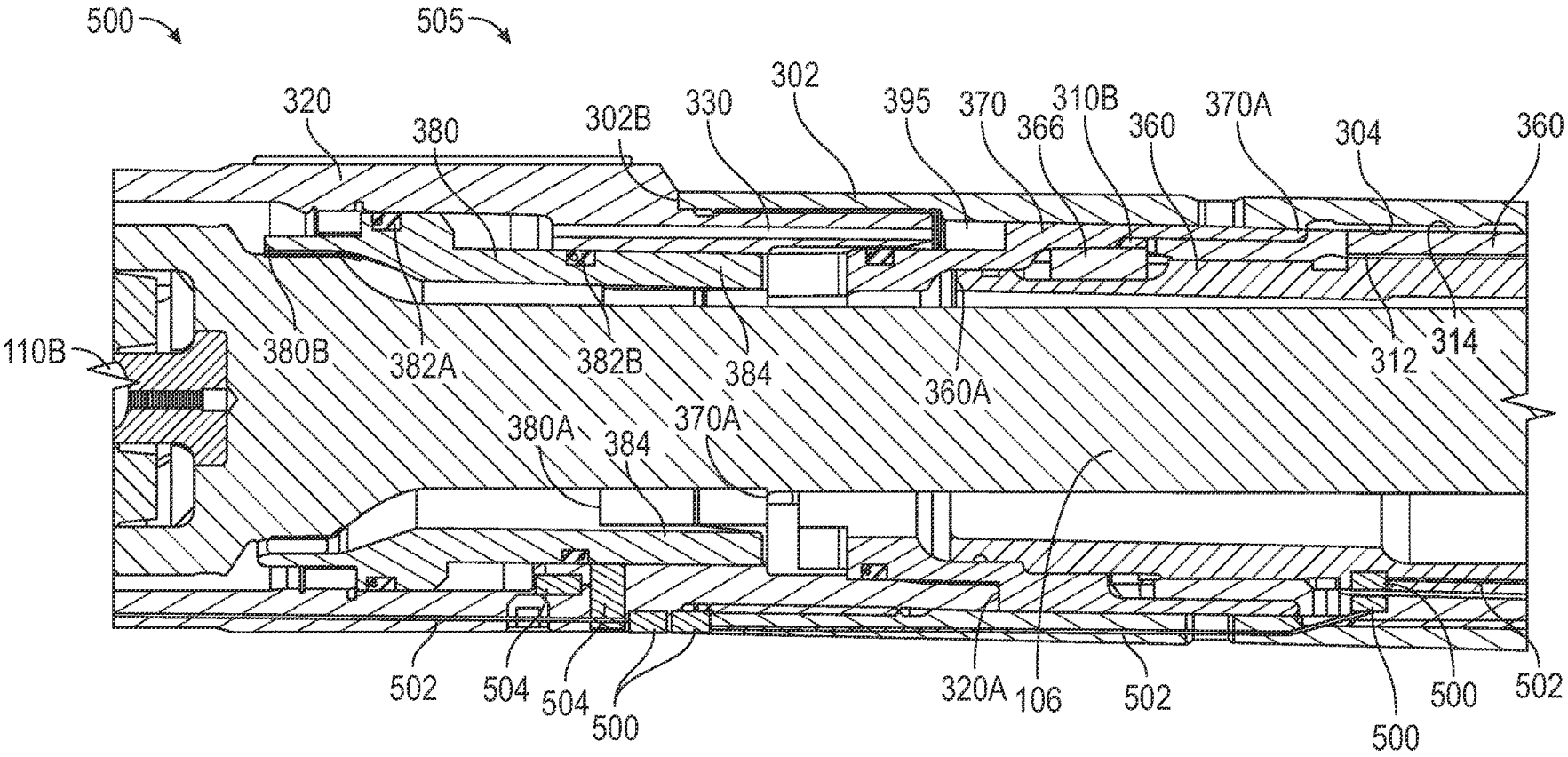

As shown particularly in FIG. 17, knowing the position of lock piston 380 could be beneficial as well as this would tell the operator which bend angle or bend setting of mud motor 500 while drilling. Particularly, the axial position of lock piston 380 varies based on the bend setting of mud motor 500, so a sensor for detecting the axial position of lock piston 380 would make it possible to detect the bend setting of mud motor 500 with sensors. This could be accomplished with proximity, LVDT or Hall effects sensors of sensor packages 504 shown in FIG. 17. Knowing the position of lock piston 380 could also allow for the ability to eliminate the choke mechanism of mud motor 500 which could further improve the ability of mud motor 500 to function in extended reach wells where pump pressure limitations come into play from time to time. The ability to eliminate this choke feature while retaining the ability to determine the bend setting of mud motor 500 while drilling could allow faster drilling operations to take place thus eliminating the need to stop and take a reference stand pipe pressure reading following shifting the bend setting of mud motor 500. Elimination of the choke feature would allow for a shorter overall length of mud motor 500 and shorter bit-to-bend on mud motor 500.

Figure 18:
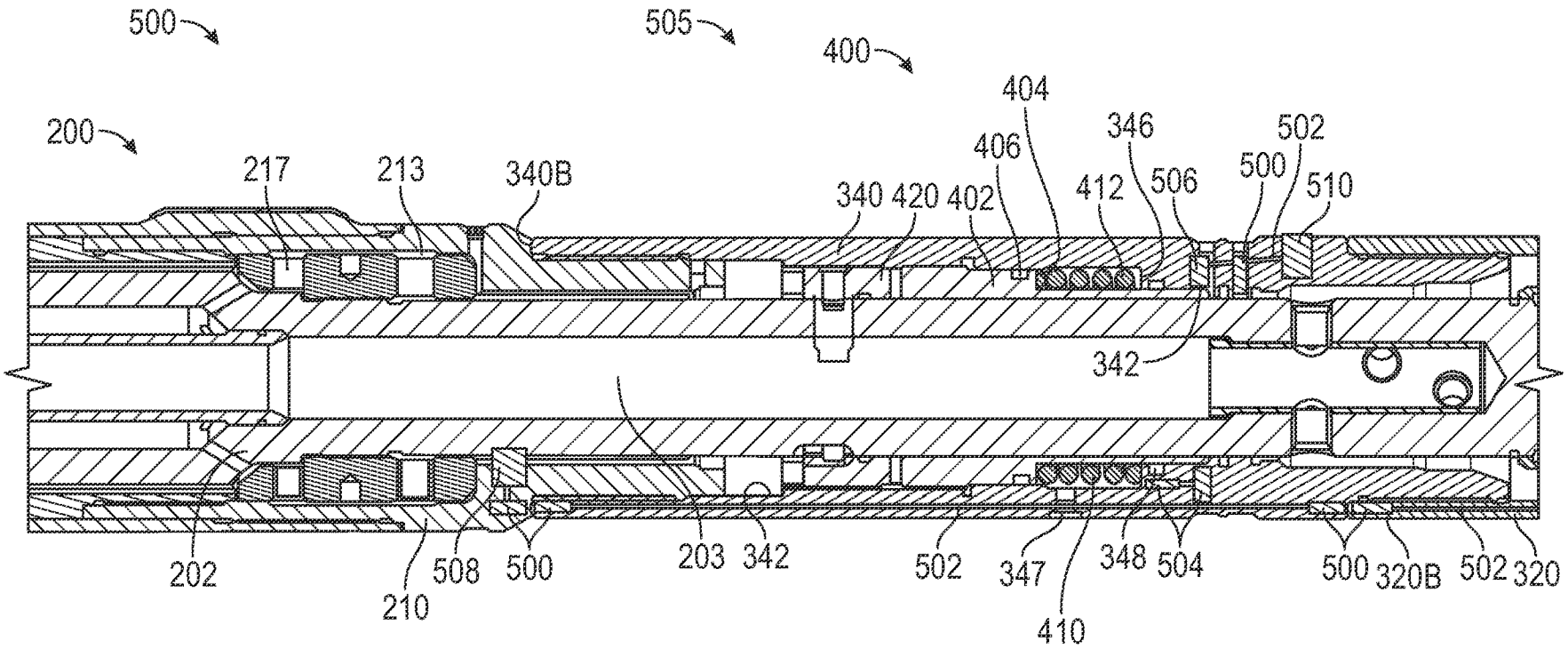
FIG. 18 is a side cross-sectional view of an embodiment of a bearing assembly of the mud motor of FIG. 15 in accordance with principles disclosed herein.
Figure 19:
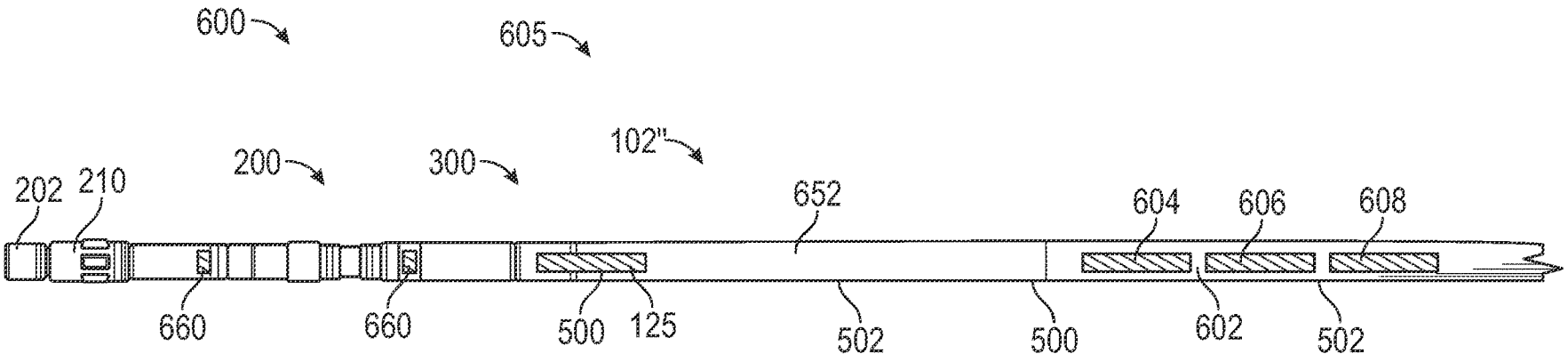
FIG. 19 is a side view of an embodiment of a drilling assembly of the drilling system of FIG. 1 in accordance with principles disclosed herein.
Figure 20:
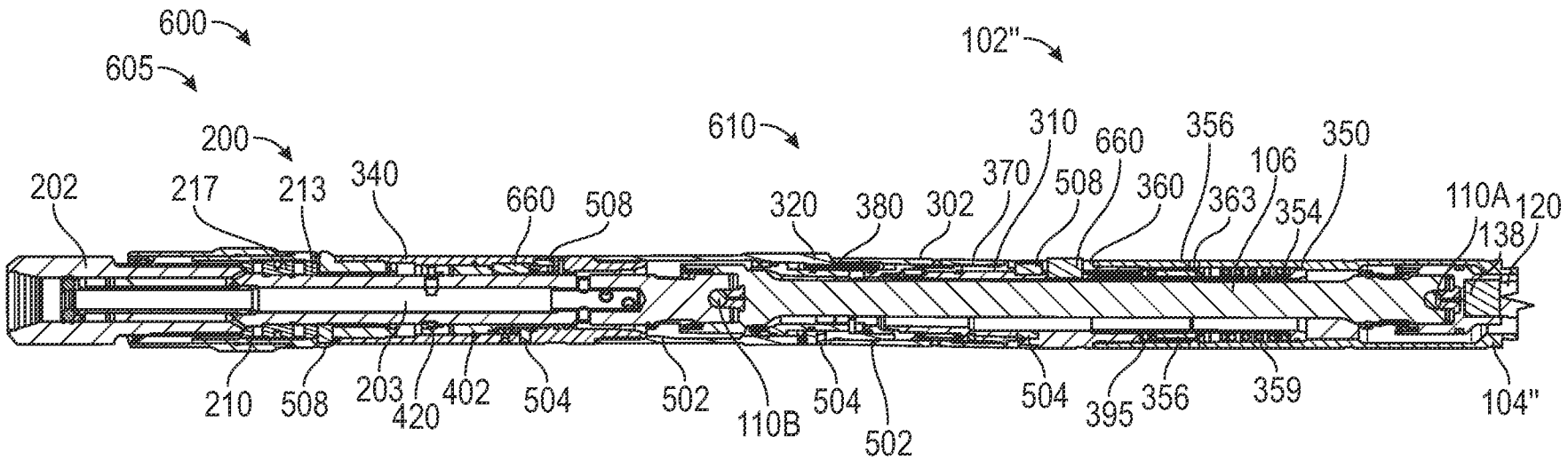
FIG. 20 is a side cross-sectional view of an embodiment of a downhole mud motor of the drilling assembly of FIG. 19 in accordance with principles disclosed herein.
Figure 21:
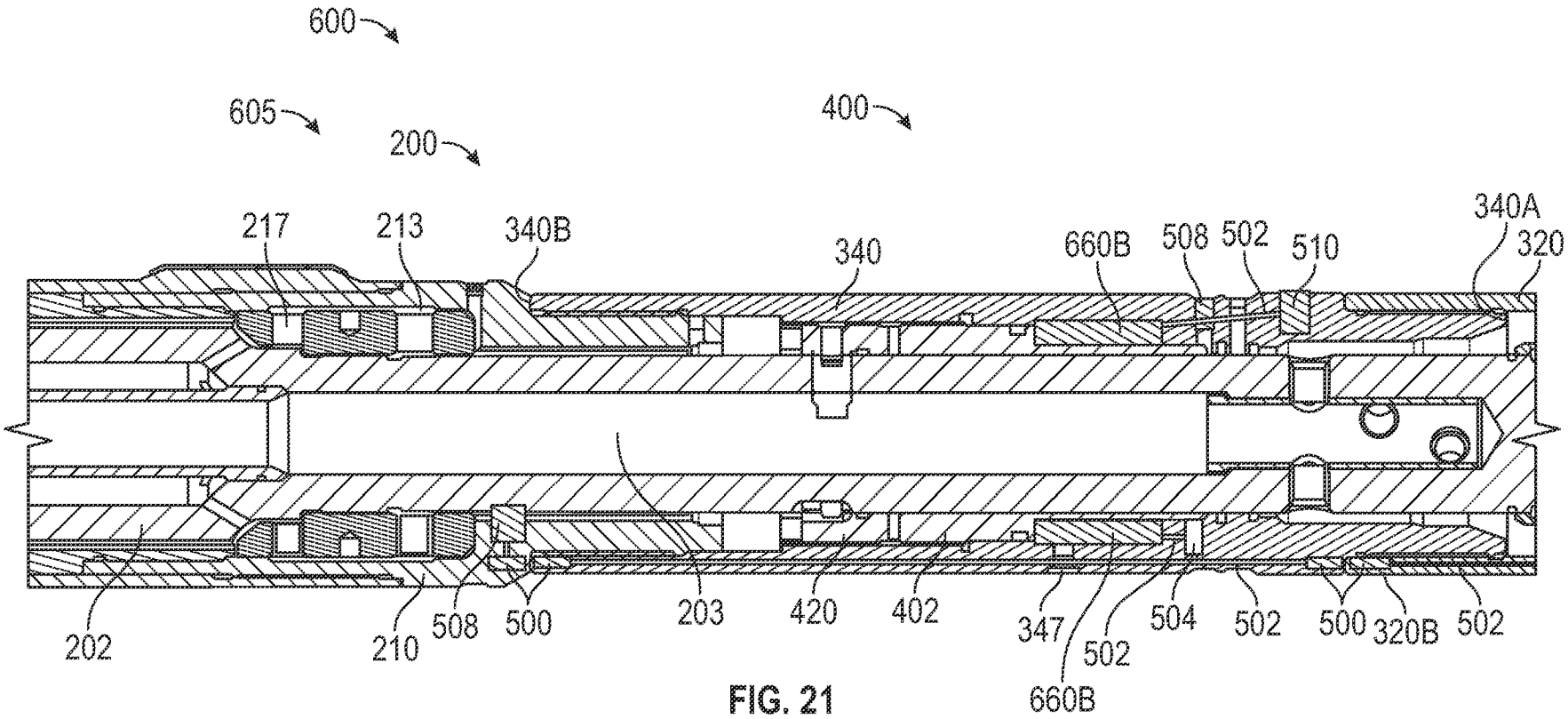
FIGS. 21, 22 are side cross-sectionals view of an embodiment of a bearing assembly of the mud motor of FIG. 20 in accordance with principles disclosed herein.

As shown in FIG. 18, mud motor 500 further includes a plurality of oscillation or RPM sensors 508 for detecting the size and speed of the oscillations of bearing mandrel 202 and changes in weight-on-bit (WOB). In some embodiments, mandrel 202 is permitted to axially oscillate relative bearing housing 210 and bearing 217 of bearing assembly 200 comprises a wavy race bearing configured to produce axial oscillations of mandrel 202. RPM sensors 508 may be beneficial for embodiments of mud motor 500 that allows reciprocation of bearing mandrel 202 using wavy race bearings, such as the wavy bearing races shown and described in U.S. patent application Ser. No. 15/565,224 (published as US 2018/0080284), which is incorporated herein by reference for all of its teachings. Impact energy imposed by the oscillation of mud motor 500 could be gathered during downhole operation and sent to surface by WDP joints, electromagnetic communication, and/or mud pulse MWD to relay the information to surface using conventionally available technology. By knowing the frequency and the energy being applied while drilling with mud motor 500, the drilling parameters could be optimized by the driller to increase ROP or mitigate problems being seen downhole. The ability to track these mandrel oscillations via sensors 508 would also allow for bit bounce and negative drilling effects seen during bit whirl and bit bounce to be mitigated by the operator of the drilling system in real time.

Figure 15:
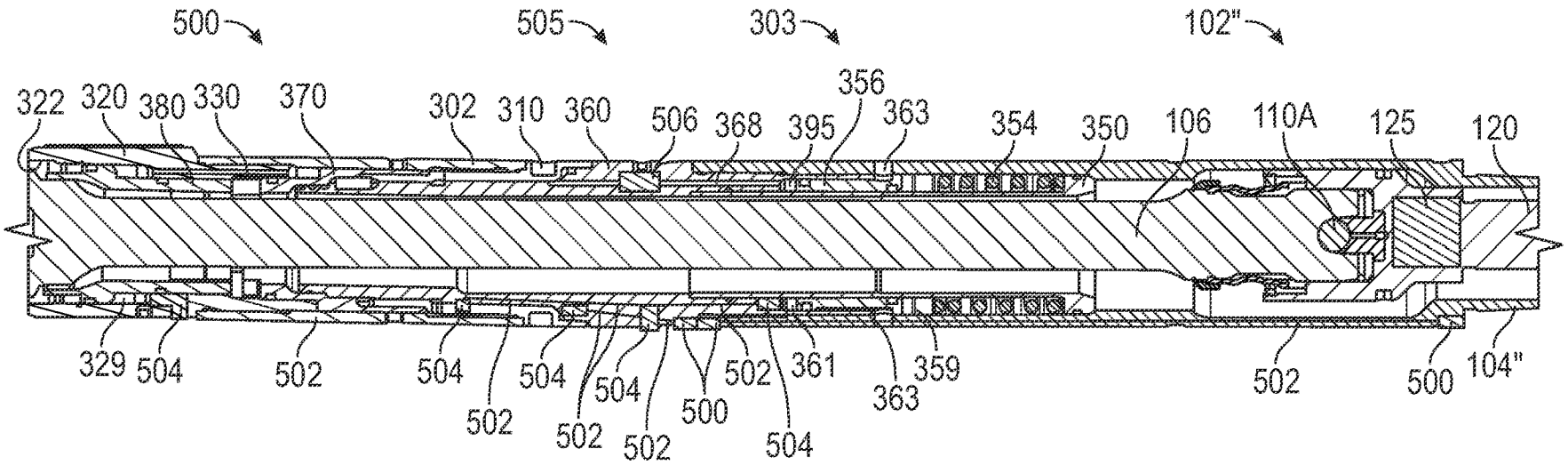
FIG. 15 is a side cross-sectional view of another embodiment of a downhole mud motor of the drilling system of FIG. 1 in accordance with principles disclosed herein.
Figure 16:
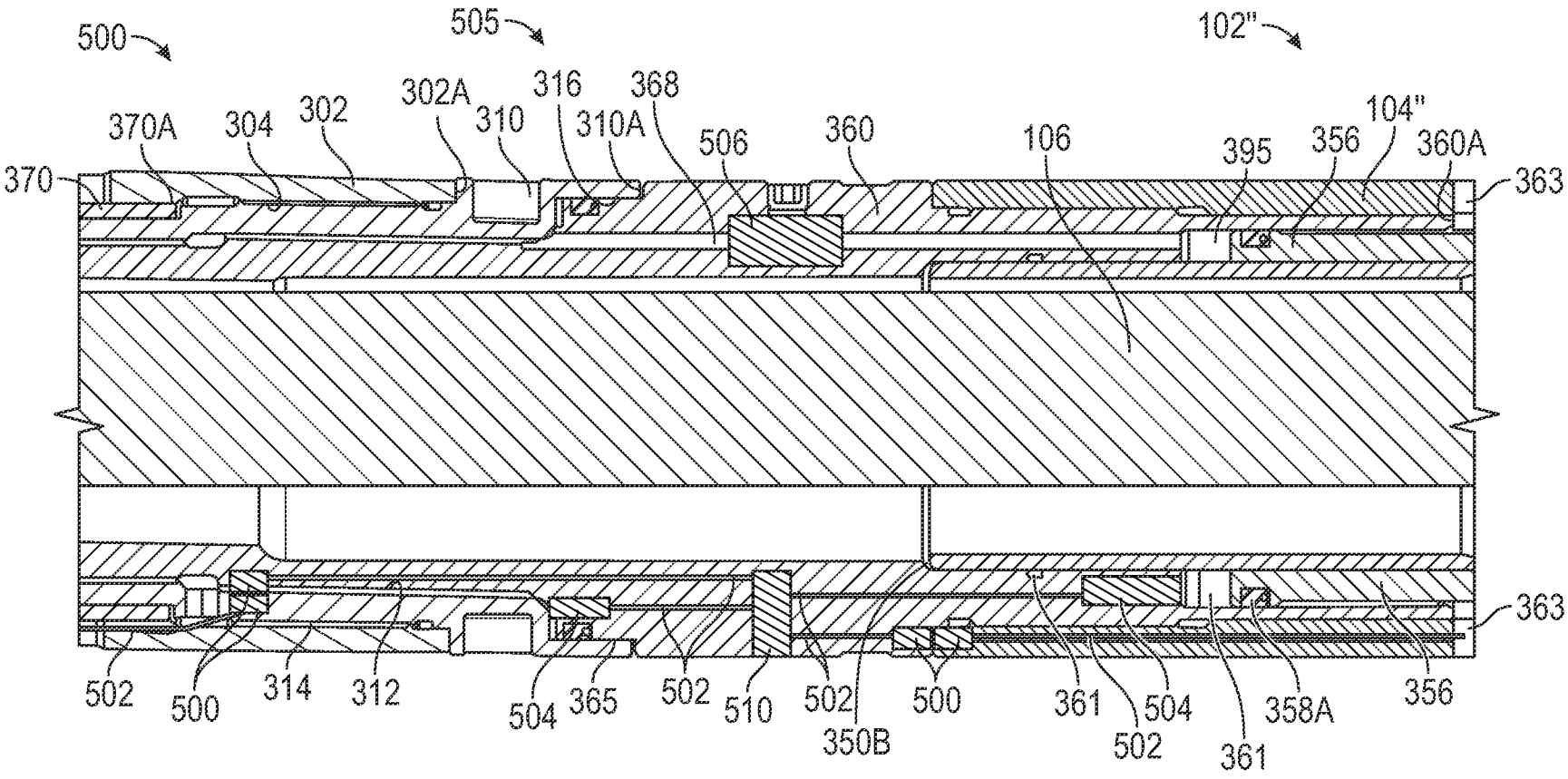
FIGS. 16, 17 are side cross-sectional views of an embodiment of a bend adjustment assembly of the mud motor of FIG. 15 in accordance with principles disclosed herein.

In some embodiments, torque and oscillation or acceleration measurements alternatively could be measured by an electronics package (e.g., electronics package 125 or 138) or pressure, force, and/or vibration sensor in driveshaft adapter 120. The data collected by the electronics package (e.g., electronics package 125 or 138) could be relayed via a short a hop device mounted inside the driveshaft adapter (e.g., via electronics package 138 disposed in driveshaft adapter 132) to the MWD tool positioned directly above the mud motor (e.g., mud motors 250, 505) and then pumped to the surface of borehole 16. By collecting the pressure, oscillation or acceleration in Gs, and the torque output data and setting minimum threshold values for the pressure, vibration, and torque measurements seen at driveshaft adapter 120 and short hopping this collected information to a MWD tool a "yes" or "no" on oscillation and locker assembly function could be determined for the mud motor. This is beneficial as the position of the mud motor's bend setting (e.g., the unbent and bent positions), oscillation frequency and magnitude, oil reservoir heath and locker assembly health could all be checked with only a wire and sensors passed between the upper offset housing 360 and the driveshaft housing 104", as shown in FIG. 15, of driveshaft assembly 102". This requires one wired connection plus a wired stator to gain all these measurements where the available cross section is large enough to place sensors and connectors more easily.

In some embodiments, the remaining electrical components would all be inside the driveshaft adapter 120 or 132 and the rotor of the power-section of mud motor 500 making packaging more convenient. Putting all the sensors, batteries and wires where they terminate in or above the upper offset housing provides a large cross sectional area in the downhole adjustable motor to place the sensors needed for the motor position sensors and internal pressure. Such a configuration would make wiring mud motor 500 less cumbersome as far as fitting sensors (e.g., sensors 504, 506, 508, and 510, etc.), batteries and wires in the assembly without the need for slip rings between the rotating components of bearing assembly 200 and bend adjustment assembly 505. This would aid reliability.

Referring to FIGS. 19-25, an embodiment of a drilling tool or downhole assembly 600 including a MWD tool 602 and a downhole mud motor 605 including a power section 652 for use with well system 10 of FIG. 1 is shown in FIGS. 19-25. In this embodiment, MWD tool 602 includes a short hop receiver 604 (communicable with the short hop transceiver of electronics package 138 of mud motor 605), a power source (e.g., batteries, turbine alternator, etc.) 606 for powering electronics package 138, and a transmitter and sensor package 608 for communicating uphole. Additionally, mud motor 605 includes an electronically controllable bend adjustment assembly 610 which includes features in common with bend adjustment assemblies 300, 505 described above. The ability to electronically actuate the lock piston 380 and the actuator piston 402 of mud motor 605 via hydraulic pumps could also be incorporated into mud motor 605. Particularly, mud motor 605 includes a plurality of hydraulic pumps 660 which negate the need for surface pump 23 to be cycled or flowrates to be moved up and down to shift mud motor 605 between its multiple positions and bend settings. By filling and evacuating oil on the low pressure side of pistons 380, 156, mud motor 605 could be cycled between its multiple positions from surface. This could be accomplished via WDP joints and the operator could directly send a signal to the tool by pushing a button or enabling a program. Secondly this could be accomplished by having a MWD tool on top of the mud motor (e.g., MWD tool 602) and wired to it via WDP joints from the MWD tool to the mud motor and then downlink to the MWD and have it tell the motor to switch positions. Downlinking could be similar to the downlinking methods described in U.S. Pat. No. 9,488,045. It could also allow the tool to be shifted without stopping drilling for at least one of the positions.

An embodiment of actuating mud motor 605 via hydraulic pumps 660 is described herein, which may occur on or off bottom of borehole 16 while drilling. In this embodiment, mud motor 605 includes one or more first or upper hydraulic pumps 660A (shown in FIGS. 23, 24) coupled to upper adjustment mandrel 360 and in fluid communication with ports 368 of mandrel 360. Additionally, mud motor 605 includes one or more second or lower hydraulic pumps 660B (shown in FIGS. 21, 22) coupled to actuator housing 340 and configured to selectably apply fluid pressure to the upper end 402A of actuator piston 402. The trigger to actuate mud motor 605 could be provided from a rotary downlink similar to the downlinks described in U.S. Pat. No. 9,488,045, or by pushing a button at the surface of borehole 16. The operation of the following procedure could also be triggered by a rotational rate or RPM threshold or a combination of RPM, flowrate, and/or pressure thresholds of mud motor 605 as well. Particularly, in some embodiments, when mud motor 605 is sliding along sidewall 19 of borehole 16 or the rotational rate of driveshaft 106 and bearing mandrel 202 below 10 RPM (average), bend adjustment assembly 610 of mud motor 605 is configured to shift to the bent position, and when driveshaft 106 and bearing mandrel 202 are rotating at a rotational rate of 30 RPM or greater, bend adjustment assembly 610 of mud motor 605 is configured to automatically actuate to the unbent position 303. In this embodiment, the actuation of mud motor 605 to the unbent position 303 is initiated by upper hydraulic pumps 660A on the low pressure side of lock piston 380, which equalizes the pressure on both sides of lock piston 380 (indicated by arrows 662 of the exhaust (high pressure) and intake (low pressure) flows in FIG. 24). In response to the equalization of pressure across lock piston 380, compensating piston 356 forces lock piston 380 downwards into the unlocked position allowing bend adjustment assembly 505 to change position. If changing from the bent position to the unbent position 303 the mud motor 605 would straighten up as soon as the drillstring 21 was rotated from the surface of borehole 16. Subsequently when upper hydraulic pumps 660A are stopped, the high pressure from the mud flow in mud motor 605 would then move the lock piston 380 uphole to re-engage the lock piston 380 to the lower offset mandrel 370 to lock mud motor 605 in the unbent position until another change was desired.

Figure 25:
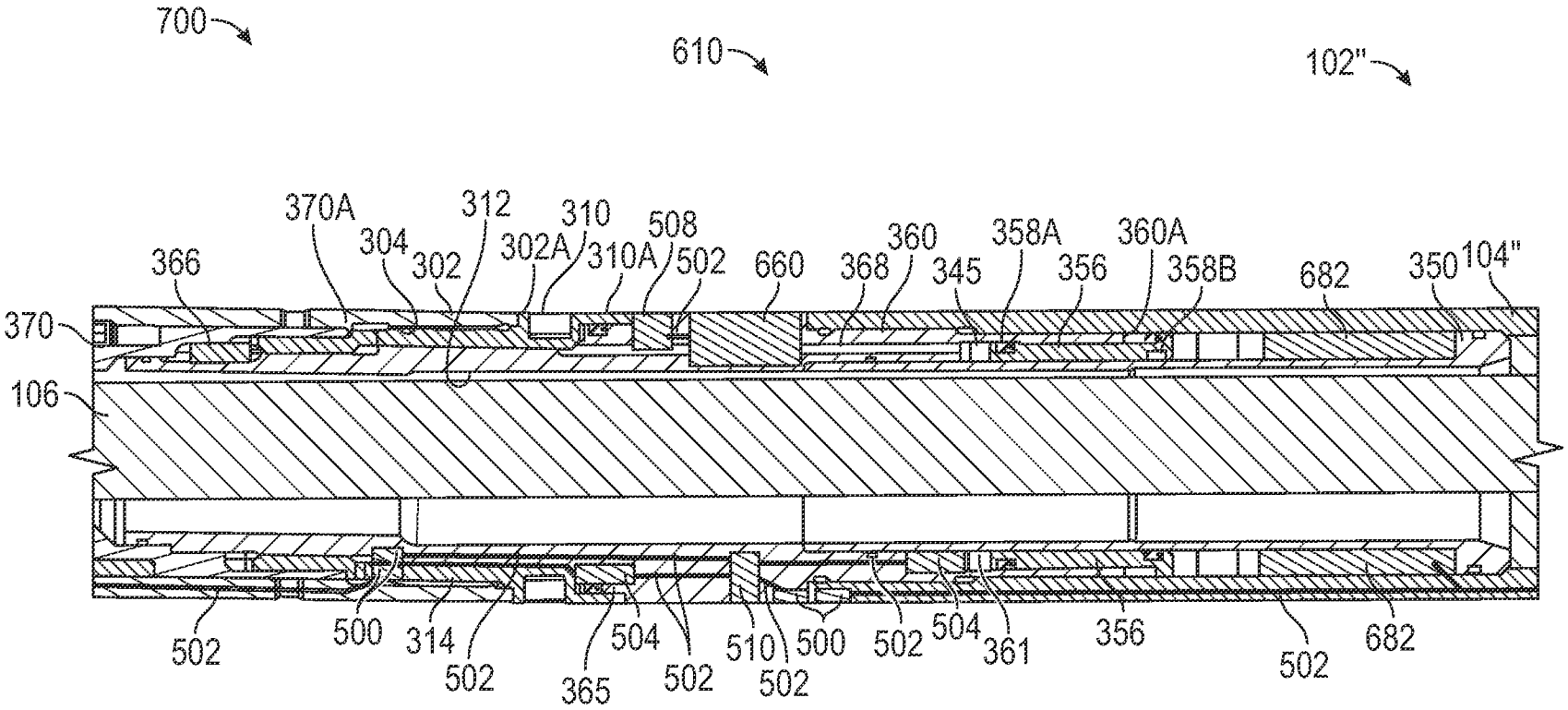
FIG. 25 is a side cross-sectional view of another embodiment of a downhole mud motor of the drilling system of FIG. 1 in accordance with principles disclosed herein.

In some embodiments, biasing member 354 for actuating compensating piston 356 may not be required if the compensating piston 356 is pressured up on the low pressure side by a second hydraulic pump 682 to return the lock piston 380 to the lower furthest downhole unlocked position instead of using a spring, as shown in the embodiment of a mud motor 700 shown in FIG. 25. Once mud motor 700 reached the unbent position the uphole hydraulic pump 682 would then vent the pressure from the low pressure side of the compensating piston 356. The high pressure from the mud flow in the internal diameter of mud motor 700 would then move the lock piston 380 uphole to re-engage the lock piston 380 to the lower offset mandrel 370 and keep the mud motor 680 locked in unbent position until another change was desired regardless of the flowrate of fluid supplied to mud motor 680.

Figure 22:
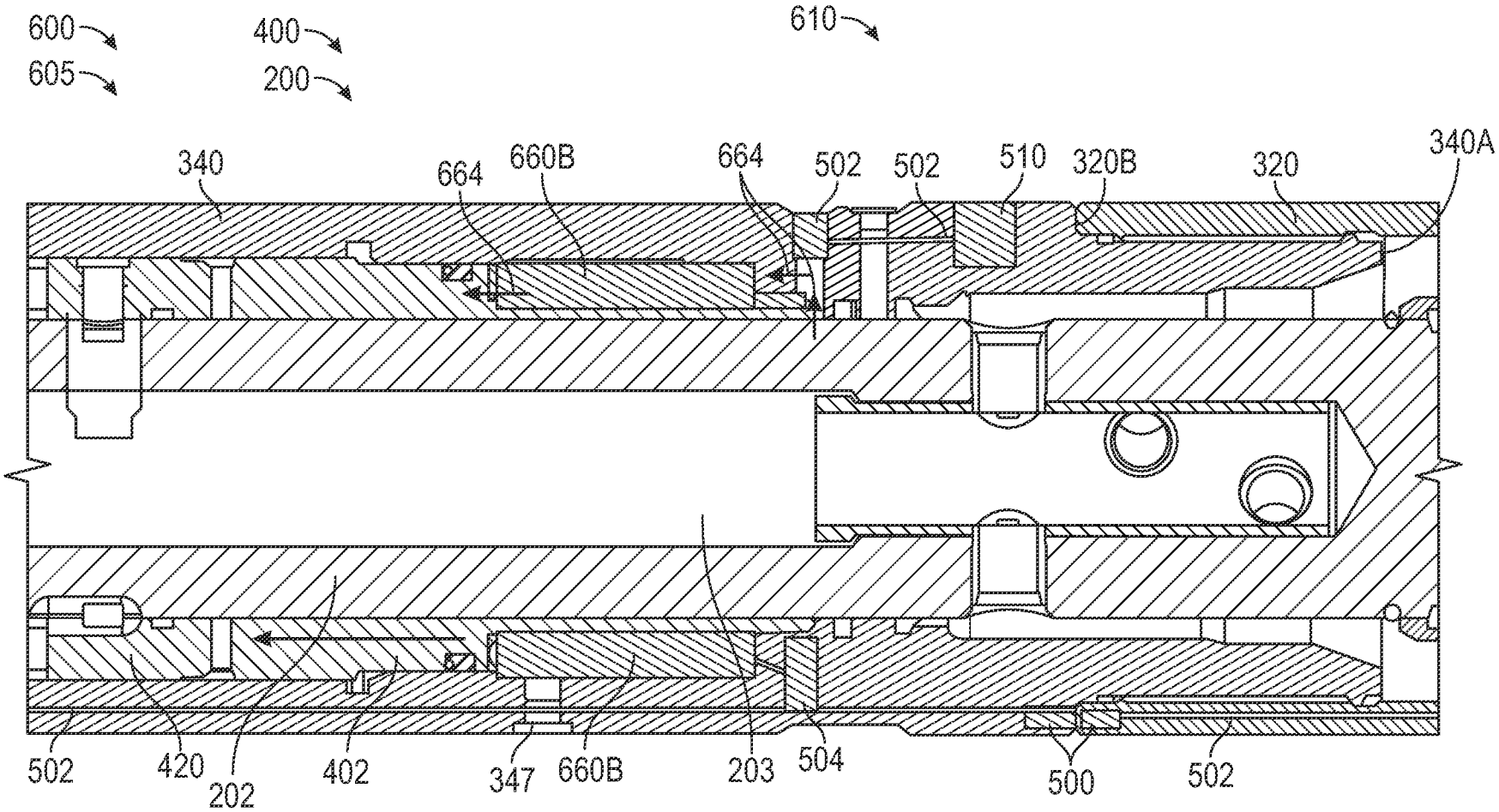
Figure 23:
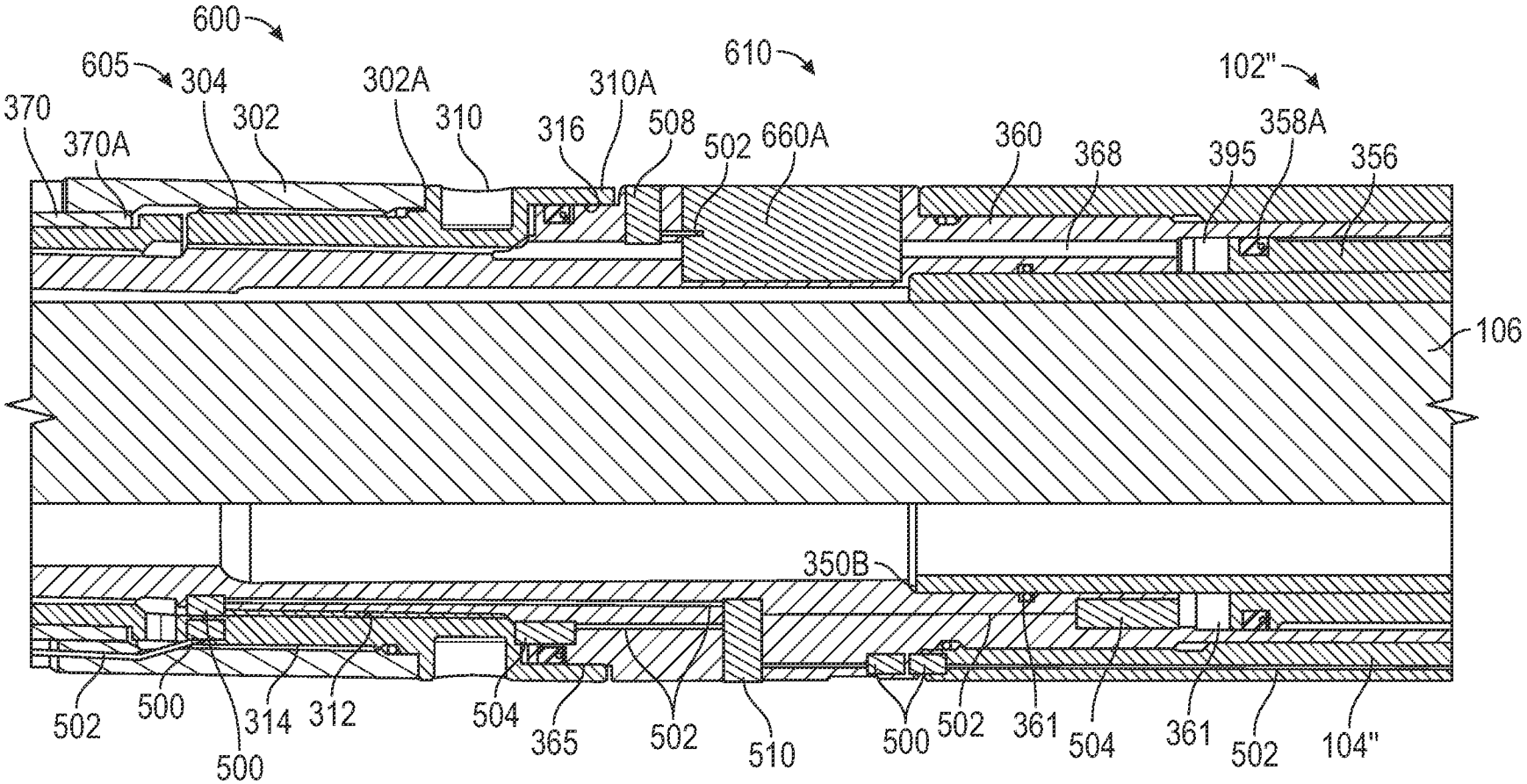
FIGS. 23, 24 are side cross-sectional views of an embodiment of a bend adjustment assembly of the mud motor of FIG. 20 in accordance with principles disclosed herein.
Figure 24:
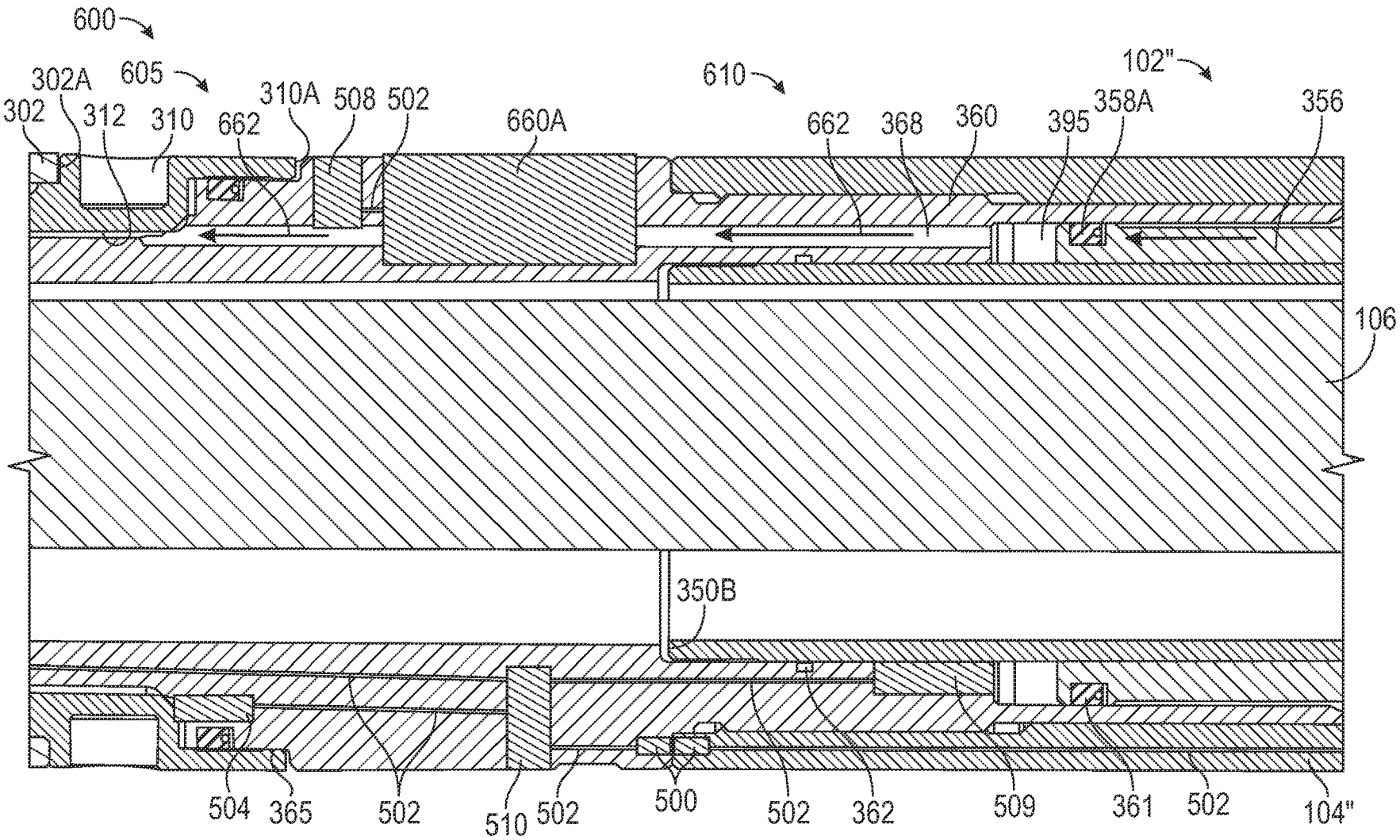

In some embodiments, if shifting mud motor 605 from the unbent position to a bent position or a low bend position to a high bend position the order of operations or series of events includes: the shifting process would start by upper hydraulic pumps 660A on the low pressure side of the lock piston 380 would begin to equalize the pressure on both sides of the lock piston 380, as shown in FIG. 24. Subsequently, compensating piston 356 begins to move the lock piston 380 downhole allowing bend adjustment assembly 610 to change position. In FIG. 22, lower hydraulic pump 660B actuates to equalize the pressure on the actuator piston 402 and cause the actuator piston 402 to engage teeth ring 420 on the bearing mandrel 202 (indicated by arrows 664 of the exhaust (high pressure) and intake (low pressure) flows in FIG. 22.

Once engaged the locker assembly of mud motor 605 pulls the bend adjustment assembly 610 into the bent position using torque from power section 652 of mud motor 605. Sensors in the adjustable section may detect the tool had reached the fully bent position. At this point the upper hydraulic pump 660A positioned proximal lock piston 380 will reverse flow and start to decrease the pressure on the uphole side of the lock piston 380 and allow the lock piston 380 to re-engage into the locked position for drilling ahead. Once the lock piston 380 has started to engage and lock, the lower hydraulic pump 660B disposed proximal actuator piston 402 reverses flow direction to lower the pressure on the uphole side of actuator piston 402 and allow the actuator piston 402 to fully disengage thus completing the shifting cycle to the bent position. In this embodiment, hydraulic pumps 660A, 660B each include a controller or processor comprising a memory that stores a setpoint configured to control the actuation of hydraulic pumps 660A, 660B. In this embodiment, hydraulic pumps 660A, 660B are in signal communication with one or more of sensor packages 504, 506, 508, and/or 510 to receive signals corresponding to rotational rate of driveshaft 106 and bearing mandrel 202, fluid pressure within mud motor 605, and/or fluid flow rate in mud motor 605.

By adding these hydraulic pumps 660A, 660B and by using WDP joints the operation of mud motor 605 may be accomplished by pushing a button at the surface of the borehole 16 and waiting for mud motor 605 to shift and send the pressure signal or the electronic sensor confirmation that it had shifted. Secondly, mud motor 605 may be shifted, with the shifting of mud motor 605 being confirmed electronically via one of the sensing methods described above. By adding hydraulic pumps 660 and sensors (e.g., sensors 304, 306, and 508, etc.) the operation of mud motor 605 may be automated and greatly simplified. The ability to shift or adjust the bend setting of mud motor 605 remotely without special operations or changes in flowrate to drill bit 90 may allow many other fully automated drilling tools to control mud motor 605 without the operator on surface having to worry about adjusting pumps or picking up off bottom to shift. Additionally, the use of these items would negate having to follow the startup sequences at each connection or when the pump goes down while drilling.

Figure 26:
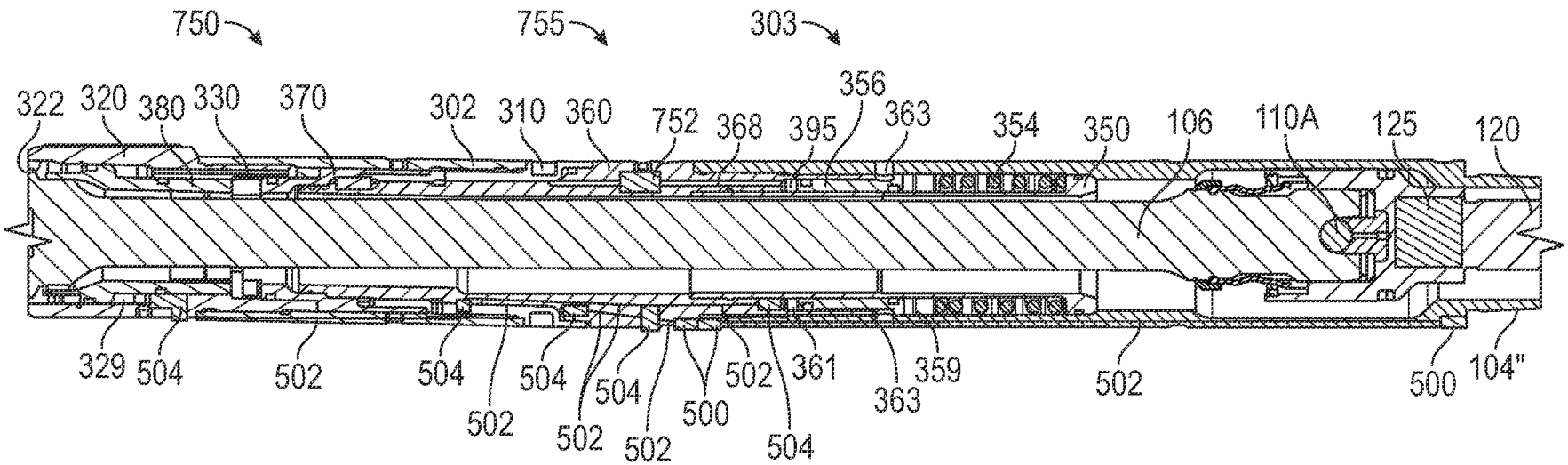
FIG. 26 is a side cross-sectional view of another embodiment of a downhole mud motor of the drilling system of FIG. 1 in accordance with principles disclosed herein.

Referring to FIGS. 1 and 26, another embodiment of a mud motor 750 for use with well system 1 of FIG. 1 is shown in FIG. 26. In the embodiment of FIG. 26, mud motor 750 includes a bend adjustment assembly 755, which while including features in common with bend adjustment assemblies 300, 505, and 605 described above, also locking feature into bend adjustment assembly 755 which locks bend adjustment assembly 755 in a given bend position (e.g., unbent position, bent position). Mud motor 750 includes one or more solenoid valves (e.g., hydraulic, electric, etc.) 752 including a battery powered PCB or electronics package or board that comprises a memory and a processor or controller. In this embodiment, solenoid valves 752 are each coupled to upper adjustment mandrel 360 and in fluid communication with ports 368 of upper adjustment mandrel 360. Solenoid valves 752 are configured to selectably block or restrict fluid flow through ports 368 of upper adjustment mandrel 360. When ports 368 are blocked by valves 752, compensating piston 356 and the fluid contained in locking chamber 395 are not allowed to move, thereby locking bend adjustment assembly 755 into its current position.

This configuration allow electronics to actuate solenoid valves 752 between a closed position restricting fluid flow through ports 368 and an open position permitting fluid flow through ports 368 in response to adjusting the RPM of driveshaft 106 via the same downlinking method described in U.S. Pat. No. 9,488,045, which is incorporated herein by reference for all of its teachings. For example, a memory of the electronics package of each solenoid valve 752 may include an RPM setpoint and a controller configured to shift solenoid valve 752 between open and closed positions in response to an RPM sensor of solenoid valve assembly 752 sensing driveshaft 106 rotating at the RPM setpoint. Additionally, the electronics package of each solenoid valve 752 may include a flowrate setpoint of fluid flowing to mud motor 750, and in response to sensing fluid flowing through mud motor 750 at the setpoint via a flow sensor of mud motor 750, the controller is configured to shift solenoid valve 752 between open and closed positions.

Alternatively, in other embodiments, solenoid valves 752 are actuated by a signal sent along wired drill pipe connections 502 and coils 500. In some embodiments, the operation of the locking feature provided by solenoid valves 752 includes: solenoid valves 752 are initially in the open position, allowing an operator of well system 10 to actuate bend adjustment assembly 755 to a desired position (e.g., the unbent position, bent position, etc.). Once an operational flowrate is established to mud motor 750, locking piston 380 is actuated to the locked position. A signal is then passed via flowrate changes to mud motor 750 and/or RPM changes of driveshaft 106 from surface (as described in in U.S. Pat. No. 9,488,045), or a signal from surface via wired drill pipe connections 500, 502 to the electronics board and solenoid valves 752 to not allow flow across ports 368 of upper adjustment mandrel 360. Once flow is blocked off across ports 368, locking piston 380 cannot be returned to the unlocked position by the biasing force supplied to compensating piston 356 by biasing member 354.

The closing of solenoid valve 752 effectively locks bend adjustment assembly 755 from shifting to a reset or alternate bend setting until solenoid valves 752 are actuated into the open position, permitting fluid flow across ports 368 of upper adjustment mandrel 360. Thus, the operator of well system 10 is permitted to shut off surface pump 23, ceasing fluid flow to mud motor 750, while still maintaining bend adjustment assembly 755 in its current bend position. When the operator of well system desires to change the bend position of bend adjustment assembly 755, the operator may disable the locking feature by sending a first or opening signal to solenoid valves 752 to actuate them into the open position permitting fluid flow through ports 368 of upper adjustment mandrel 360. Once fluid flow is permitted through ports 360, the operator of well system 10 may mechanically shift bend adjustment assembly 755 to an alternate bend position. Once the operator has reached the alternate bend position of bend adjustment assembly 755 and the drilling flowrate is provided to mud motor 750 by surface pump 23, a second or closing signal is transmitted to solenoid valves 752 to actuate valves 752 into the closed position preventing fluid flow through ports 368 and locking bend adjustment assembly into the alternate bend position. In this embodiment, solenoid valves 752 are configured to actuate into the open position in the event of a failure to supply electrical power to valves 752, permitting the operator of well system 10 mechanically shift bend adjustment assembly 755 as described above.

In some embodiments, the signal to open and close solenoid valves 752 is triggered by fluid pressure within the central passage of upper adjustment mandrel 360, as sensed by a pressure sensor in signal communication with solenoid valves 752. This way the operator of well system 10 could flow fluid to mud motor 750 at a high flowrate to generate this high pressure to lock and unlock the tool by closing and opening solenoid valves 752, and then reduce the flowrate supplied to mud motor 750 to an operational or drilling flowrate. Additionally, in this embodiment only upper adjustment mandrel 360 need include electronics (solenoid valves 752) in order to permit the electrically actuated locking of bend adjustment assembly 755, where upper adjustment mandrel 360 has a relatively large cross section to place package electronics, batteries, and wires, etc., therein compared to other components of bend adjustment assembly 755. In other embodiments, solenoid valves 752 may be positioned in lower offset housing 320 for selectably permitting and restricting fluid flow through ports 330 thereof to thereby lock and unlock bend adjustment assembly 755.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure presented herein. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A downhole motor for directional drilling, comprising:

a driveshaft assembly including a driveshaft housing and a driveshaft rotatably disposed within the driveshaft housing;

a bearing assembly including a bearing housing and a bearing mandrel rotatably disposed within the bearing housing, wherein the bearing mandrel is configured to couple with a drill bit;

a bend adjustment assembly configured to adjust a bend setting of the downhole motor;

a lock piston comprising an unlocked position, and a locked position configured to lock the bend setting of the bend adjustment assembly;

one or more hydraulic pumps configured to actuate the lock piston into the unlocked position to unlock the bend adjustment assembly; and an electronics package configured to indicate the bend setting of the bend adjustment assembly.

2. The downhole motor of claim 1, wherein the electronics package is configured to indicate whether lock piston is in the locked position or the unlocked position.

3. The downhole motor of claim 1, further comprising a solenoid valve configured to lock the lock piston into at least one of the locked and unlocked positions in response to receiving a locking signal.

4. The downhole motor of claim 1, wherein the bend adjustment assembly comprises an actuator piston configured to, in response to actuating the actuator piston from a deactivated position to an activated position, actuate the bend adjustment assembly between a first position that provides a first deflection angle between a longitudinal axis of the driveshaft housing and a longitudinal axis of the bearing mandrel, and a second position that provides a second deflection angle between the longitudinal axis of the driveshaft housing and the longitudinal axis of the bearing mandrel that is different from the first deflection angle.

5. The downhole motor of claim 4, wherein the electronics package is configured to indicate whether the actuator piston is in the deactivated position or the activated position.

6. The downhole motor of claim 1, wherein the electronics package comprises an electromagnetic short hop transmitter configured to communicate with an electromagnetic short hop receiver disposed in a measurement-while-drilling (MWD) tool coupled to the downhole motor.

7. The downhole motor of claim 1, wherein the electronics package comprises an electromagnetic communication link.

8. The downhole motor of claim 1, wherein the one or more hydraulic pumps are configured to actuate the bend adjustment assembly includes a first position that provides a first deflection angle between a longitudinal axis of the driveshaft housing and a longitudinal axis of the bearing mandrel, and a second position that provides a second deflection angle between the longitudinal axis of the driveshaft housing and the longitudinal axis of the bearing mandrel that is different from the first deflection angle.

9. A downhole motor for directional drilling, comprising:

a driveshaft assembly including a driveshaft housing and a driveshaft rotatably disposed within the driveshaft housing;

a bearing assembly including a bearing housing and a bearing mandrel rotatably disposed within the bearing housing, wherein the bearing mandrel is configured to couple with a drill bit;

a bend adjustment assembly configured to adjust a bend setting of the downhole motor;

a lock piston comprising an unlocked position, and a locked position configured to lock the bend setting of the bend adjustment assembly;

a solenoid valve configured to lock the lock piston into at least one of the locked and unlocked positions in response to receiving a locking signal; and an electronics package configured to indicate the bend setting of the bend adjustment assembly.

10. The downhole motor of claim 9, wherein the electronics package is configured to indicate whether lock piston is in the locked position or the unlocked position.

11. The downhole motor of claim 9, further comprising a hydraulic pump configured to actuate the lock piston into the unlocked position to unlock the bend adjustment assembly.

12. The downhole motor of claim 9, wherein the bend adjustment assembly comprises an actuator piston configured to, in response to actuating the actuator piston from a deactivated position to an activated position, actuate the bend adjustment assembly between a first position that provides a first deflection angle between a longitudinal axis of the driveshaft housing and a longitudinal axis of the bearing mandrel, and a second position that provides a second deflection angle between the longitudinal axis of the driveshaft housing and the longitudinal axis of the bearing mandrel that is different from the first deflection angle.

13. The downhole motor of claim 12, wherein the electronics package is configured to indicate whether the actuator piston is in the deactivated position or the activated position.

14. The downhole motor of claim 9, wherein the electronics package comprises an electromagnetic short hop transmitter configured to communicate with an electromagnetic short hop receiver disposed in a measurement-while-drilling (MWD) tool coupled to the downhole motor.

15. The downhole motor of claim 9, wherein the electronics package comprises an electromagnetic communication link.

16. The downhole motor of claim 9, further comprising one or more hydraulic pumps configured to actuate the bend adjustment assembly includes a first position that provides a first deflection angle between a longitudinal axis of the driveshaft housing and a longitudinal axis of the bearing mandrel, and a second position that provides a second deflection angle between the longitudinal axis of the driveshaft housing and the longitudinal axis of the bearing mandrel that is different from the first deflection angle.

* * * * *